US006196631B1

(12) United States Patent
Larson

(10) Patent No.: US 6,196,631 B1
(45) **Date of Patent: *Mar. 6, 2001**

(54) ERGONOMIC FOOTRESTS FOR ERGONOMIC CHAIRS

(76) Inventor: John E. Larson, P.O. Box 1197, Hamilton, MT (US) 59840-1197

( * ) Notice: Subject to any disclaimer, the term of this patent is extended or adjusted under 35 U.S.C. 154(b) by 0 days.

This patent is subject to a terminal disclaimer.

(21) Appl. No.: 09/246,679

(22) Filed: Feb. 8, 1999

Related U.S. Application Data

(63) Continuation-in-part of application No. 08/925,089, filed on Sep. 8, 1997, now Pat. No. 6,036,268.

(51) Int. Cl.[7] ..... A47C 1/034; A47C 7/50
(52) U.S. Cl. ..... 297/423.26
(58) Field of Search ..... 297/423.25, 423.2, 297/423.26, 423.28

(56) References Cited

U.S. PATENT DOCUMENTS

| | | | | |
|---|---|---|---|---|
| 4,819,987 | * | 4/1989 | Stringer | 297/723.26 |
| 5,039,167 | * | 8/1991 | Sweet | 297/423.26 X |
| 5,352,020 | * | 10/1994 | Wade et al. | 297/423.26 |
| 5,612,718 | | 3/1997 | Bryan | 345/168 |
| 5,890,766 | * | 4/1999 | Tsai | 297/423.28 |

* cited by examiner

*Primary Examiner*—Anthony D. Barfield
(74) *Attorney, Agent, or Firm*—Jerry Johnson

(57) ABSTRACT

An ergonomic footrest comprises a chair attachment bracket for attachment to the underside of a work chair seat, a footrest actuating mechanism supported by the chair attachment bracket for rotational movement in relation to the chair attachment bracket, and a footrest mechanism including a footrest brace and at least one footrest support arm. The footrest support arms each have a first and second end. The first end of at least one support arm is attached to the footrest brace. The second end of at least one support arm is attached to the footrest actuating mechanism. The support arms moveably suspend the footrest brace in relation to the chair attachment bracket. Rotational movement of the footrest actuating mechanism causes the footrest brace to move in relation to the chair attachment bracket. Rotational movement of the footrest actuating mechanism is typically manually performed through the rotation of arm rests or hand grips which are integrated into the actuating mechanism. Alternatively, the actuation mechanism may include gas spring mechanisms. The ergonomic footrest may include two or four footrest support arms attached to the foot rest brace and the footrest actuating mechanism. The support arms, the footrest brace, and the footrest actuating mechanism comprise a parallelogram structure, which supports the footrest platform for curvilinear translation movement in relation to the work chair seat.

33 Claims, 25 Drawing Sheets

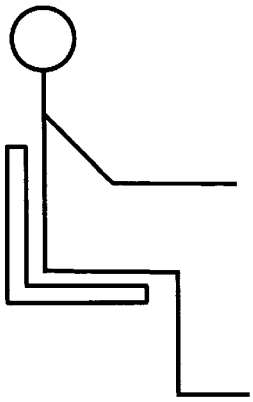
Fig. 14 A1
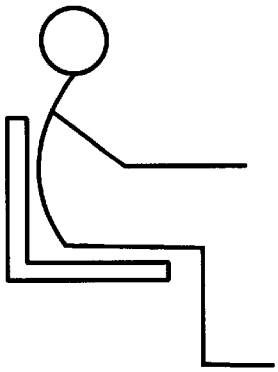
Fig. 14 A2
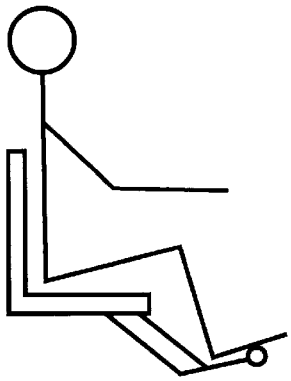
Fig. 14 A3
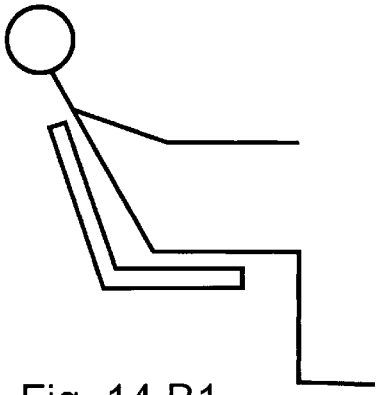
Fig. 14 B1
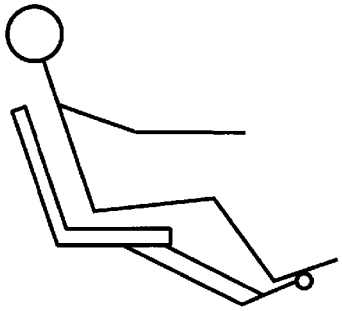
Fig. 14 B2
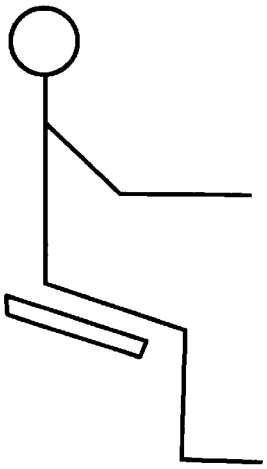
Fig. 14 C1
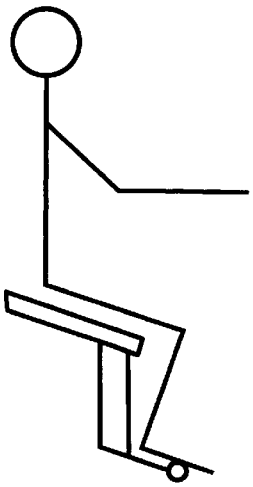
Fig. 14 C2

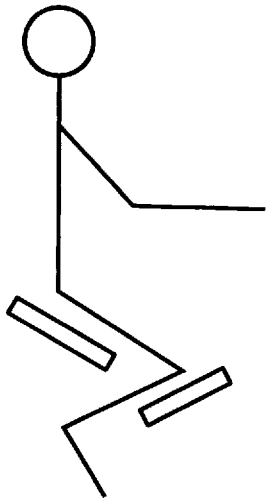
Fig. 14 D1
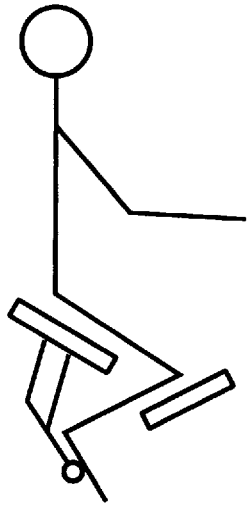
Fig. 14 D2
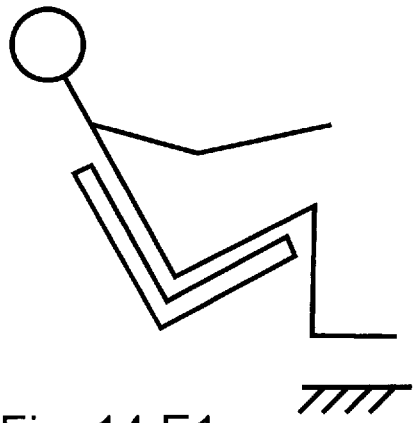
Fig. 14 E1
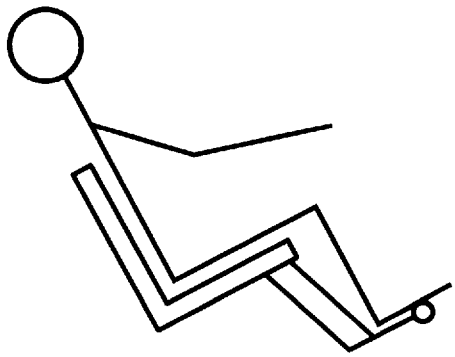
Fig. 14 E2
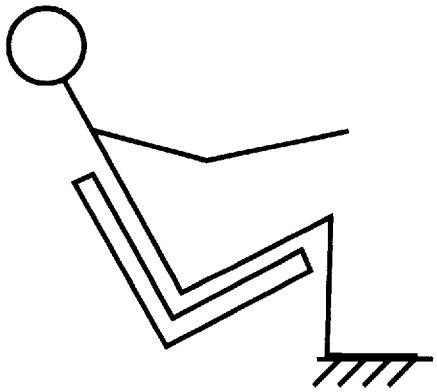
Fig. 14 F1
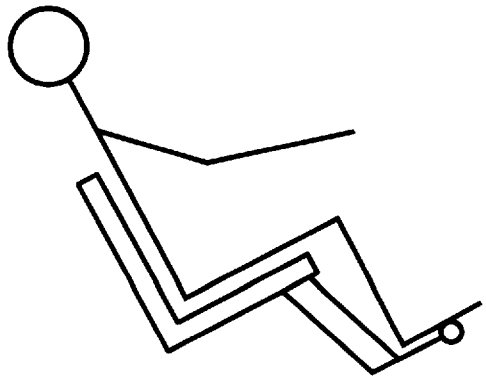
Fig. 14 F2

ERGONOMIC FOOTRESTS FOR ERGONOMIC CHAIRS

RELATED APPLICATIONS

This application is a continuation-in-part of U.S. patent application Ser. No. 08/925,089 filed Sep. 8, 1997 now U.S. Pat. No. 6,036,268.

BACKGROUND

Seated workers in home, office and industrial environments often experience back pain and other physiological difficulties as a result of ergonomic deficiencies of the various chair designs on the market. Often these difficulties are a result of the absence of appropriate support for the chair user's feet. Due to the problems of discomfort and injury associated with seated work, ergonomic research has been undertaken to identify the causes of these problems and to recommend solutions. In particular, this research has been undertaken to study existing chair designs as well as to develop new chair designs. From this work, six principal chair designs have been identified. Scientific theories have been developed to support claims of ergonomic deficiencies of particular chair designs, as well as to support claims of ergonomic solutions provided by particular chair designs. The chairs embodying these theories are in wide use today.

One such chair design, commonly known as "bench" seating, provides a horizontal seat pan with or without a vertically upright backrest. Users of this chair must exert their back muscles to sit upright while keeping their feet flat on the floor, with their lower legs at a ninety-degree angle to their upper legs. This bench seating or upright posture does allow the sitter to achieve a natural inward curvature of their lower spine without any supportive assistance from the backrest. However, the bench seating posture has been shown by ergonomic researchers to be quite unnatural, as people invariably slouch rearwardly or forwardly into a position in which their back assumed a convex curvature. This tendency to slouch while in bench seating has been shown to occur whether a backrest was provided or not. This is because the bench or upright sitting posture requires a conscious effort to exert the back muscles to hold this position. Recent ergonomic testing has shown that the average person can only maintain this upright bench seating posture for about 3½ minutes.

Because people invariably succumb to forward or rearward slouching, a vertical backrest is typically added to bench style chairs to help the sitter maintain straightness of the back and minimize the extent of the slouch. However, to make supportive contact with the backrest, sitters on a bench style chair have to lean back slightly from the hip/spine juncture. Adjusting the posture of the upper body by leaning back causes the upper back of the sitter to contact the backrest. This, in turn, creates a gap between the sitter's lower back and the lower portion of the backrest. This rearward slouching, when viewed from the side, appears like the letter C, with an outward bowing, or curvature of the spine. The supportive contact points in this posture are the upper back on the backrest, and the butt on the seat pan. The poor posture resulting from slouching rearward to utilize the backrest for support actually increases the strain on the back and causes even greater outward curving of the lower back. This pathological condition is recognized as a cause of many sitting related back injuries.

Kyphosis is the medical term used to describe the previously mentioned pathological condition of the lumbar area of the spine being curved outward. Kyphosis results in a misalignment of the vertebrae that causes uneven pressure on the vertebral discs. Over time this continuous uneven pressure can rupture or wear down the forward edge of the disc. This is due to the concentration of pressure on only a small local area of the disc. The pressure on the forward edge of the disc is caused by the gravitational pull on the upper body of the seated person. As the seated person assumes a slouched, or kyphotic position, the gravitational forces (upper body weight) are leveraged onto this small frontal disc area. This leveraged pressure on the small frontal disc area is extreme and over time can cause misalignment of the vertebrae. Vertebral misalignment causes pinching of the spinal nerves, which results in extreme back pain that disables the worker.

When standing, the vertebral discs of the human spine are set in a curve that acts to evenly distribute the weight of the upper body throughout the entire surface of the discs so that the entire disc area bears the load. This natural inward curvature of the lower back is referred to as "lordosis". When a person is walking, bending, or lifting, the forces on the discs do concentrate on small specific areas of the discs, but only for brief time periods because the person's motion quickly alternates the pressure from one part of the disc to another. However, when a person is seated, there is little or no muscle movement and therefore no alternation of muscle tension. This static tension registers as pain to the person's nervous system that triggers an instinctual relief mechanism whereby a shift of body position redistributes muscle tension and disc pressure to other locations. This instinctual body shifting is scientifically termed "unconscious mechanataxes". Commonly it is known as squirming. This squirming constantly shifts stressed pressure points and fatigued muscle areas from one surface location or area to another, by alternation. Accordingly, alternation through squirming may be viewed as a natural defense mechanism that acts to relieve static stress.

A bench seated person who is attempting to maintain equalized disc pressure in the lower back through conscious use of back muscles to maintain lordosis (natural inward curving of the spine when standing) invariably fatigues these muscles. In order to relieve this muscle stress, the sitter slouches in his or her chair thus shifting the stress away form one set of back muscles and the evenly pressured discs over to a different set of muscles and the frontal portions of the vertebral discs. This alternation of posture may relieve some muscle discomfort for a while, but at the expense of causing serious injury to the discs. A lumbar support positioned at the lower portion of the backrest offers no improvement towards achieving lordosis because there is nothing forcing the lumbar support into the lower back, as bench posture does not force the user's lower back into the back cushion. Despite these known problems associated with bench seating, it remains the most widely used chair posture in the world.

A second chair design, often called a "Grandjean" chair provides a horizontal seat pan and a backrest which tilts rearward in relation to the horizontal seat pan at an angle between 104 degrees and 113 degrees. This chair was conceived from the observation of rearward slouching of people on their bench style chairs. Accordingly, the reclined backrest was designed to provide support for the sitter's back in the reclined position while the sitter is on a bench chair seat pan. Though the backrest reclined, the load bearing contact points for the sitters were, as with the bench chair, upper back on backrest cushions and butt on seat pan. With the sitter's lower legs perpendicular to the upper legs and feet flat on the floor as recommended, support for the lower back was still negligible. The gap occurring between the lower back and the lower back cushion on the bench chair design was reduced somewhat by the Grandjean reclined backrest but there was still no significant force on the lower back to prevent kyphosis. Because the Grandjean chair encourages rearward slouching, no conscious exertion of back muscles is required, as sitting up straight is not the posture accommodated by this chair design. So, one problem associated with bench seating, muscle fatigue, was solved by Grandjean by encouraging the second problem occurring with the bench chair, slouching.

A third chair design often called a "Mandal" chair provides a seat pan having a forward, downward tilt with an upright back cushion. A. C. Mandal theorized a chair with a forward tilting seat pan incorporated into the overall chair design. He also observed that this tilted seat pan rotated the sitter's pelvis forward causing lordosis of the spine similar to the natural lordosis occurring with the pelvic alignment of a person who is standing. Lordosis is the inward curving of the lower spine that aligns the lumbar discs for even load bearing throughout the entire disc surface. When the method of pelvic rotation is applied to a sitting posture, the benefits are the same as with standing. Neither the Mandal sitting posture nor the standing posture require conscious exertion of back muscles, because the back muscles, in lordosis, are evenly tensed. Neither the standing posture nor the pelvic-rotated sitting posture of Mandal require outside support to maintain the posture. For this reason, the backrest of a Mandal chair is superfluous. However, as the Mandal chair promotes lordosis, chairs of this design provide very secure and comfortable support for the upper body.

The main drawback of the Mandal sitting posture is the tendency for the sitter to slide forward out of the forward sloped seat pan cushion. Chair designers lessened this problem by using rough fabrics to frictionally prevent sliding. This, however, causes skirts and pants to rise up. The most reliable method to prevent forward sliding in these chairs is for the sitter to brace his feet on the floor, or an appropriate foot support to prevent foot sliding. Effective bracing in a Mandal chair is accomplished when the user's lower leg is set from a slightly acute angle to a perpendicular angle to the user's upper leg. This bracing results in statically tensed leg muscles, which may fatigue quickly. Additionally, if the sitter was elevated too high off the floor without an appropriate foot support, there would be no bracing from the feet.

A fourth chair design, often called a "Balans" or "backless" chair provides a seat pan having a forward tilt and a knee rest having a rearward tilt. This chair neither has a backrest nor does it need one as the forward tilting seat pan, like the Mandal, causes a forward pelvic rotation in the sitter. And, as previously mentioned, this forward pelvic rotation positions the upper torso of the user very securely and comfortably. Invented as a solution for the Mandal sliding problem, this chair with its rearward tilting knee cushion set out in front of the forward tilting seat pan, braces against the sitter's knees thus preventing forward sliding without the sitter having to experience muscle fatigue in their legs. This chair design solved the leg muscle fatigue problem of the Mandal chair, but created a new problem unique to its design. The pressure from the knee cushion caused localized pressure point pain on the knees after about twenty minutes of continuous sitting. Larson U.S. Pat. No. 5,330,254 solved this problem by having the front and rear cushions rotate freely thus shifting the knee pressure points constantly up and down along the shins throughout the workday.

A fifth chair design, often called a "center-tilt", was popular in the 1930s and has made a comeback in today's market. Since the seat pan along with the back cushion both rotate backwards together, the gravitational forces (upper body weight) are distributed evenly along the whole longitudinal length of the sitter's spine as it is pushed by gravity against the chair backrest. This results in more even pressures to the upper and lower back areas. And, as the upper body is pushed by gravity against the chair backrest, the chair user will benefit from the lumbar support provided by the chair backrest. In this way, the center-tilt chair eliminates the lower back gap occurring with a bench chair or Grandjean chair. The center-tilt chairs available today also rock back and forth which provide an additional advantage of relocating or shifting the load among the lumbar discs.

There is, however, a significant problem associated with center-tilt chairs. Because the whole body of the sitter rotates backwards, the knees of the sitter rise in relation to the floor as the body rotates backwards. The rising knees lift the sitter's feet off of the floor, leaving the feet and legs dangling in mid air. There is agreement among ergonomic researchers that unsupported legs constitute a very undesirable chair sitting condition due to the deleterious pulling effects that dangling legs have on the sitter's lower back and upper legs. Also, the sitter's lower legs in this chair hang suspended at an angle less than 90 degrees to the upper legs. This condition restricts blood circulation in the legs and causes muscle cramping. Blood circulation is also restricted due to the sharp angle of the seat pan pressing into the back of the legs just above the knee.

Many of the problems associated with the resultant undesirable lifting of the legs caused by leaning back in a center-tilt chair were solved by the knee-tilt chair. The knee-tilt chair, the sixth chair design, relies on a tilting mechanism that is hinged at the front of the seat pan to allow the user to lean back in the chair without causing their legs to rise. I the height of the seat pan is correctly set for a given chair user, the knee tilt chair does provide a sitting posture that allows gravity to push the user into the seat backrest so that slouching is less likely and that a lumbar support, if included in the chair back rest, will provide proper lumbar support.

Like the center-tilt chair, the knee-tilt chair may be undesirable to many workers, as both chairs promote a reclined seating position.

As previously discussed above, all of the six principle chair designs have deficiencies that are specific to their respective design.

A first deficiency shared by all of the chair designs is derived from the fact that most chairs are designed for a single sitting posture and thus do not offer the chair user the ability to vary the sitting position a sufficient amount for performing different tasks. As different tasks in the workplace require different postures for maximizing both comfort and efficiency, a chair that limits the user to a specific posture may require the user to perform a given task in an inappropriate posture. Furthermore, the chair user is often limited to a small amount of adjustment within the specific posture that the chair allows. In this way, many chairs that are claimed to provide healthful sitting restrict the user to limited movement. Restricting movement while sitting often leads to the chair users incurring static stress injuries from the inability to reposition their body as they typically would, were they offered more postural choices. These deficiencies of adjustability are a reality of current chairs, despite the many adjustment provisions that are incorporated into each of these chair designs.

The theories supporting all of the above ergonomic chairs also give little attention or respect to how the feet are supported in each respective chair design. Nevertheless, how the feet are supported in each of these chairs is a determining factor for the effectiveness of each design. All of the previously mentioned chair designs, with the exception of the Balans, have a recommended position where the upper and lower legs are roughly at a 90 degree angle and the feet are placed flat on the floor. The Mandal sitting position also often requires a slight reduction of the angle created by the upper and lower legs to less than 90 degrees. This 90 degree leg and foot position is currently recommended as it has been recognized as necessary to prevent the legs and feet from pulling the user out of the sitting position. Were the legs pulling the user out of the sitting position, there would be excessive back strain to overcome the pulling forces.

Typically a seat pan height adjustment is required for the user to place their legs in the currently recommended position where the feet are placed flat on the floor and the upper and lower legs form an angle of approximately 90 degrees. This height is typically defined as the "popliteal" height. Most work chairs offer height adjustment to accommodate the placement of the seat pan at a desired level to accommodate their leg length. However, a problem encountered with ergonomic seating in the work place is that certain chair users will fall outside of the height adjustment range of their chair, and thus, will not be able to set the seat to a level that is appropriate for their physiological requirements.

People of shorter stature often use chairs that will not vertically adjust to a low enough seat pan height. Unable to set the seat pan at an appropriate level for their required seating position, the users of these chairs are susceptible to both discomfort and injury. With their chairs not adjustable to a low enough height for their stature, these workers are typically unable to position their feet on the floor and as a result may dangle their legs from the chair. Because of the pulling effect of the weight of the legs and feet, these chair users will typically be pulled forward in their chair and caused to sit in a forward slouched position. Unable to use the floor for supportive body bracing, muscle driven lordosis is impossible leaving the user with the typical back rounding condition known as kyphosis.

Workers attempting to position themselves at a high desk or table face a similar problem. In this situation, the desk or table height is not appropriate for upper body comfort until the chair seat is adjusted to the recommended height for their elevated tasking requirements. A common situation encountered in the work place, that exemplifies this problem, is the placement of keyboards of desktop computers and notebook computers on the top of a desk or worktable. Commonly, these keyboards are often at a position that is uncomfortably high for many workers. Workers in this situation are often unable to achieve a comfortable sitting position for the entire body. When the chair seat is adjusted to the recommended level for proper back and leg support, it sets the worker too low for the recommended arm and shoulder comfort. This situation causes the arms to be in a position where the forearms and wrists are susceptible to injury. Shoulder discomfort and injury may also result form this position.

Many workers faced with the use of high work desks and worktables often elevate their chair so as to emphasize proper elbow, arm and hand positions at the expense of foot support. This new seat height that is too high for their feet and legs might cause the user to dangle their legs from the chair causing excessive strain on the remainder of the body to support the legs in this position. By compromising the proper placement of their legs and feet, these workers are typically unable to maintain any supportive contact of their back to the chair backrest and thus tend to slouch in their chair.

The typical solution that is suggested to workers of short stature to improve their posture is to use a footrest to raise their feet above the floor. Once the feet are raised, the user can more easily sit in a proper ergonomic sitting posture that allows full body comfort. The same solution is typically suggested to workers who work at an elevated work height such as a high table and need to raise their seat pan height to accommodate the needs of their upper body. The use of footrests, as is typically suggested by ergonomists in these instances, is for the sole purpose of essentially raising the floor up to the height of the feet so that the feet are supported in the position required by various sitting positions.

"Ergonomic" is typically defined as the efficient fitting of the human being with those inanimate things, especially machines, with which he or she must efficiently interact. "Footrest" is defined as a support for the feet. There are currently six principle footrest designs available for seated people. Each of these principle footrest designs will be described below. The ergonomic functioning of each design will also be evaluated.

One such footrest design consists of a horizontal ring or square attached to a chair at a fixed height between a the chair seat pan and the chair base. In the case of a chair with legs, it would be known as a chair rung. In the case of a chair vertically supported by a non height adjustable center column, the footrest is typically a ring attached to the center column at a fixed height between the seat pan and the chair base. The ring is typically supported outward from the center chair support column with radial spokes.

This footrest design is not considered ergonomic because its location below and inward from the edge of the seat pan requires the user's legs to assume an acute angle to achieve supportive contact. This acute angle (less than 90 degrees) pressures the edge of the seat pan into the underside of the user's thighs which restricts blood circulation and causes leg cramping and nerve tingling. Another non-ergonomic aspect is that even if this chair had seat height adjustability, this footrest design would not adjust correspondingly. In fact, this footrest has no height adjustment at all. And without height adjustability, its already limited usefulness is limited even further to a narrow height range of chair users. Due to the above deficiencies, this footrest is not considered to be ergonomic.

A second footrest design consists of a radial supported ring fastened to the center column of a chair with a sliding sleeve. This ring includes a set screw knob for locking the height adjustment between the seat pan and the chair base. Although this footrest is height adjustable, it shares with the first footrest design the inward location from the seat pan edge and its consequent leg and feet problems. Height adjustment with this footrest design requires the chair user to dismount from the chair and kneel down every time a height adjustment is made. This takes the seated worker away from the work at hand with sufficient inconvenience that the height adjustment capability is seldom utilized. These deficiencies render this footrest design to be considered non-ergonomic.

A third footrest design consists of a horizontal bar or a ring which depends from the underside of a chair seat pan which is mounted on a height adjustable column. When the seat pan is raised or lowered with a gas spring or screw turn device, the footrest correspondingly is raised and lowered. This footrest design approaches ergonomic status but stops short due to the fact that the distance between the footrest and the seat pan is fixed permanently at the factory and therefore has no capability to accommodate the height variances of different chair users. Nor can this footrest be height-set for the popliteal lengths of tall or short people. And, like the first and second footrest designs, this footrest is also located inward of the chair seat's edge, again requiring an acute leg angle under the chair with the resultant feet and leg problems.

A fourth footrest involves the spokes of the chair base doing double duty as both a primary support for the chair and at the same time supporting the feet of the person sitting in the chair. This footrest is in widespread use by many chair users for lack of a better option. One problem with this footrest is that most chairs are swiveled by the chair users throughout the day and this constantly changes the spoke locations in relationship to the swiveling seat pan. This requires the chair user to constantly seek out the new spoke locations rendering feet placement unreliable. Another problem is that chairs with gas spring height adjustability conveniently lift the chair away from the floor-supported spokes. For the chair user who requires elevated seating, this results in the user being prevented from utilizing this footrest. For instance, this footrest would be inaccessible to a tall person who was elevated to drafting table work height, or a short person who was elevated to an appropriate keyboard height. The fixed height of this footrest allows a limited range of chair users whose leg length just happens to be the same distance from the chair base spokes to the seat pan when the chair seat is height adjusted for the user's appropriate work table level. As with the preceding footrest designs, this one is located inward from the seat cushion necessitating an acute leg angle to access it, which causes physiological problems with the legs and feet. There are too many serious deficiencies with this footrest for it to be considered ergonomic.

It should be noted that all four of these footrest designs share one common feature that is considered highly ergonomic. This is that each of the respective footrest locations, inward from the seat cushion, allow the chair user's feet easy access to the floor which allows the user to efficiently maneuver the chair from one location to another. Chair mobility is a valuable ergonomic feature for the modern workplace. This ergonomic feature helps to make the overall chair ergonomic but not the footrest.

A fifth footrest design consists of a floor-mounted platform independent of the chair. This footrest is seldom made to be height adjustable and being independent of the chair, cannot be height adjusted to correspond with height adjustments made to the chair. A single chair user may require differing chair height settings during the day for tasks requiring different table heights such as from keyboard table, to standard table, to drafting table. Another deficiency is that this footrest must be hand carried to different locations where the chair user may perform different tasks. Alternatively, several footrests would have to be purchased for placement in multiple locations. This footrest also does not serve multiple users of a single chair very well when the chair must be height adjusted to accommodate varying user heights, as this footrest does not respond to the height adjustments made to the chair.

Although not typically considered a footrest, the floor is the sixth footrest design. The floor is the universal footrest as it supports the feet directly in a broad range of circumstances such as standing, stooping, running, and sitting. For a chair user, the floor is oftentimes very effective at supporting the feet. It is widely used and provides infinite range for extending the chair user's legs, as was also true of the fifth chair design, the independent platform, whose distal relationship with the chair is floor dependant. The primary limitation of this footrest is the inability of this footrest to be height adjusted to correspond to the user's leg length. The most important requirement for using this footrest is that the seated person's feet are able to reach the floor. If the chair is adjusted too high the user's legs may dangle as the floor does not rise with the chair seat. There are many circumstances where the user is seated too high from the floor for supportive contact with the floor to be possible. Accordingly, this footrest is not considered to be ergonomic due to it's zero height adjustment capability.

The above described footrests have typically been suggested to chair users so that they may assume one of the previously mentioned chair sitting positions that their chair design allows. In most instances, the footrests currently available accomplish the goal of providing chair users a means to elevate their feet to a desired height, albeit with numerous ergonomic and functional deficiencies.

Additionally, all of the above described footrests have not been suggested as a way to improve on the chair sitting positions provided by existing chair designs, despite the deficiencies of each of these designs. For example, someone using a footrest to achieve what is currently recommended as a proper leg and foot position for the bench or Grandjean seating position, will still struggle to obtain adequate backrest support while sitting in the bench or Grandjean position. In the case of the foot ring type footrest, the user is restricted to a foot position that actually inhibits the user in assuming any of the previously mentioned chair sitting positions.

For these reasons, there is a need for an ergonomic footrest mechanism for a work chair that accomplishes the goals of existing footrest mechanisms in allowing chair users of differing body builds (such as those of short stature) and workers using a high desk to position their chair seat at an appropriate height for their upper body while providing support for their feet at this chair height. There is a need that this ergonomic footrest addresses the previously mentioned deficiencies of existing footrest mechanisms by being readily accessible at all of the different locations where the user performs work tasks. There is a need that the ergonomic footrest mechanism allows independent adjustability of the position of the footrest in relation to the chair seat pan to accommodate differing body builds that may use the chair. This independent adjustability is also necessary to accommodate the differing postures that may be required by each user to accomplish different tasks. There is also a need for an ergonomic footrest mechanism that can be efficiently retracted out of the way for easy foot access to the floor.

Most importantly, there is a need for an ergonomic footrest mechanism that does not merely allow the user to properly assume a currently recommended sitting posture that is provided by the chair design of their choice, but addresses the deficiencies of the existing recommended sitting postures provided by current chair designs. In particular, there is a need for an ergonomic footrest mechanism that allows chair users of all body builds sitting in the postures provided by any of the following chair designs: bench, Grandjean, Mandal, Balans, and center-tilt, and knee-tilt; to first maximize the benefits of each of these designs; and second to improve the postural functioning of each of these chair designs. For example, users of the bench and Grandjean chairs have a need for an ergonomic footrest that will provide them an enhanced ability to maintain better supportive contact of the lumbar region of their back on the chair's backrest. This supportive contact is essential for maximizing lower back support and thus minimizing discomfort and injury. There is further need for an ergonomic footrest mechanism that improves on each of these current designs by also allowing ease of positional adjustability or variance that each of these current designs restrict. This positional adjustability is necessary for the benefit of the chair user in assuming a correct posture for differing work tasks, as well as to allow users to reposition their body to minimize static stress. There is a need for an ergonomic footrest mechanism of this type which can be attached to existing work chair designs including elevated stools as well as non-elevated office type work chairs. There is also a need that the ergonomic footrest mechanism be both attractive in appearance and inexpensive to manufacture.

SUMMARY

The present invention satisfies all of the previously mentioned needs for an ergonomic footrest mechanism for work chairs. The ergonomic footrest of the present invention provides benefits to chair users in two significant ways. First, the ergonomic footrest significantly improves on the sitting postures offered by current chair designs. This benefit is accomplished by allowing the users of the many currently available chair designs to position their feet in a variety of desired positions including an ergonomically elevated and extended position that has not been previously available. Second, the ergonomic footrest offers significant improvement over all prior art footrests. These and other benefits of the ergonomic footrest will be described in greater detail after the following summary.

The ergonomic footrest of the present invention comprises chair attachment means for attachment to the underside of a work chair seat, a footrest actuating mechanism supported by the chair attachment means for rotational movement in relation to the chair attachment means, and a footrest mechanism including a footrest brace and at least one footrest support arm. The footrest support arms each have a first and second end. The first end of at least one support arm is attached to the footrest brace. The second end of at least one support arm is attached to the footrest actuating mechanism. The support arms moveably suspend the footrest brace in relation to the chair attachment means. Rotational movement of the footrest actuating mechanism causes the footrest brace to move in relation to the chair attachment means.

The ergonomic footrest in one version of the invention comprises four footrest support arms. The support arms are attached to the footrest actuating mechanism. The four support arms, the footrest, and the footrest actuating mechanism comprise a parallelogram structure, which supports the footrest platform for curvilinear translation movement in relation to the work chair seat.

The footrest mechanism in a second version of the invention comprises two footrest support arms. The two support arms are attached to the footrest brace. The two support arms are also attached to the footrest actuating mechanism. The two support arms, the footrest, and footrest actuating mechanism comprise a pendulum structure which supports the footrest brace for rotational movement in relation to the work chair seat.

The footrest actuating mechanism typically includes at least one actuating lever and a drive mechanism. The drive mechanism transfers rotational movement of the actuating lever to curvilinear translational movement of the footrest in relation to the work chair seat in the first version of the invention. The drive mechanism transfers rotational movement of the actuating lever to rotational movement of the footrest in relation to the work chair seat in the second version of the invention.

The drive mechanism may typically include a gearing mechanism which transfers rotational movement of the actuating lever to rotational or curvilinear translational movement of the footrest brace in relation to the work chair seat; wherein a small rotational movement of the actuating lever causes a large rotational or curvilinear translational movement of the footrest brace. This gearing mechanism may include gear mechanisms, chain and sprocket mechanisms, or belt and pulley mechanisms.

The ergonomic footrest may include two actuating levers; wherein each actuating lever includes an armrest or where each actuating lever includes a handgrip. The ergonomic footrest may additionally comprise means to adjust the vertical position of the footrest brace on the footrest support arms as well as means to lock the footrest actuating mechanism in a fixed position in relation to the chair attachment means.

In another version of the ergonomic footrest, the footrest actuating mechanism includes a spring mechanism supported by the chair attachment means. The spring mechanisms is typically a gas spring, however, other spring materials such as metal coil springs may be used. The gas spring mechanism includes a gas spring cylinder and a gas spring piston. The gas spring piston moves axially in relation to the gas spring cylinder. The footrest actuating mechanism additionally includes means to actuate movement of the gas spring piston in relation to the gas spring cylinder. Movement of the gas spring piston in relation to the gas spring cylinder of the footrest actuating mechanism causes the footrest to move in relation to a chair attachment means.

In this version of the footrest mechanism, the gas spring includes an actuation button, and the means to activate movement of the gas spring piston in relation to the gas spring cylinder comprises a lever actuated cable mechanism or a lever actuated plate to depress the actuation button.

The ergonomic footrest of the present invention provides benefits previously unavailable to users of work chairs.

A significant benefit provided by the ergonomic footrest is the ability of users of chairs with the footrest to support their feet in an elevated and extended position relative to the chair seat. Most chair designs have a recommended foot position where the upper and lower legs are roughly at a 90 degree angle and the feet are placed flat on the floor. While this position does allow chair users sitting in the bench sitting posture to position their back so that the natural curvature of the back is achievable in this seated position, there is strong tendency for the chair user in the bench and Grandjean positions to round their back into a slouched position where only the upper back is in contact with the chair backrest and the lower back receives little or no supportive contact from the chair backrest.

The ergonomic footrest of the present invention allows chair users to support their feet in an elevated and extended position allowing the legs to assist in the bracing of the back against the chair backrest. In this and many other ways, the ergonomic footrest of the present invention is used differently from a leg rest. Accordingly, the chair user can more easily maintain the natural curvature of their back as the bracing of the feet in this position allows the chair user to maintain supportive contact with the lower back on the lumbar padding of the chair backrest. Were the legs in the previously recommended position at 90 degrees and neither elevated or extended, little or no bracing would be provided by the legs for this supportive contact to occur at the chair backrest. Chair users would have to rely on their back muscles to maintain their posture, which typically results in the chair user slouching after a relatively short period of sitting. In many cases the foot and leg position currently recommended actually pulls the user away from the chair backrest and inhibits the supportive contact that could be provided by the chair backrest.

The center-tilt and knee-tilt chairs are unique in that the chair seat pan rotates backward with the backrest as one unit. In the center-tilt chair, it is of utmost importance for the legs to be supported in the elevated and extended position offered by the present invention as the feet are elevated off the floor when the user reclines in the chair. In the absence of a proper footrest, the legs are left to dangle from the chair seat while the upper body muscles will strain to support the weight of the legs. The present invention converts this very undesirable result to healthful usage of this chair.

Another benefit provided by the ergonomic footrest of the present invention is the ability for work chairs utilizing the footrest to accommodate people of short stature who often fall outside the range of adjustability of many work chairs. The ergonomic footrest allows these chair users to position their chair to a proper height in relation to work desk or table. Once the chair height is set the footrest allows their feet to be placed at the desired position relative to the chair seat. Chair users of all sizes will benefit from this aspect of the invention as many workers commonly use work desks and tables that are too high for the worker to achieve a proper posture with existing work chairs not having an ergonomic footrest.

A further benefit provided by the ergonomic footrest of the present invention is the ability of the footrest to be placed so that the upper and lower legs of the chair user are supported at a 90 degree angle and the feet easily contact the footrest. This, as previously stated, is a currently recommended foot position and is useful for many tasks. Or, if desired, the footrest may be placed at an extended position well in front of the chair seat, which has significant benefits over the 90 degree position. The footrest could also be placed in a position closer to the chair seat for a less than 90 degree foot position. This position is of particular importance to those using a chair of the Mandal design having a forward tilting seat pan. This footrest position allows these users to maintain the correct posture for this chair even if the chair seat needs to be raised to a vertical position, which would be too high for foot placement on the floor. These positions allow the user to place the legs in a recommended ergonomic position for sitting at a work chair. This positional adjustability allows the user to easily sit in a variety of ergonomic postures, some that allow for the achievement of lordosis of the spinal column, and some that maximize the support offered by the back cushion of the chair.

Discomfort in the legs is also minimized by the ergonomic footrest. This aspect of the invention would benefit all chair users who have difficulty in placement of their legs into a comfortable ergonomic position. The difficulty may arise due to a worker's short stature, their height may cause the worker's legs to dangle from the chair seat. As previously mentioned, the difficulty may also arise from a worktable or desk that is too high. The worker may have raised the chair seat to provide greater upper body comfort, but compromises leg and feet position and comfort by the chair seat height adjustment. Stool users who use a fixed footrest underneath the chair seat also maintain a leg position that causes circulatory restriction. All of these situations would benefit from the use of the footrest mechanism of the current invention.

Another benefit of the ergonomic footrest is the positional adjustability that is offered to the chair user. The footrest can be easily set in the desired position relative to the chair seat. The footrest mechanism can also be easily repositioned, to accommodate changes in seating position. Such small changes to the seating position are considered to be helpful in avoiding static stress injuries to the body while working. Additionally, such seating changes are often necessitated by different work tasks. Unlike currently available chairs, a chair having the ergonomic footrest easily accommodates these movements while ensuring that proper posture is maintained. The footrest may also be adjusted vertically in relation to the chair seat to accommodate users of all sizes, multiple positions of a single user, or multiple users of a single chair. In one version of the invention the vertical adjustment can be accomplished while seated.

Another benefit of the ergonomic footrest of the present invention is the ease with which the footrest is actuated. The footrest in the first preferred version is either armrest actuated or handgrip actuated. The footrest actuating mechanism of the invention supports either armrests or handgrips that allow the user to manually actuate or move the footrest into a desired position. The armrests or handgrips also allow the user to quickly retract the footrest to a position under the chair seat to allow unobstructed contact with the floor. Easy retraction of the ergonomic footrest ensures that foot powered chair mobility is preserved for workers that move about among various work locations.

The ergonomic footrest actuating mechanism, which supports either an armrest or handgrips, rotates a shaft. The shaft may include a locking mechanism having detents at spaced positions which temporarily locks the mechanism in place. As moving the armrests or handgrips forward or rearward causes the footrest platform to move correspondingly, this feature also temporarily locks the footrest platform in place. In other versions the locking function may be accomplished by a gas spring or by foot actuation on the footrest. In a preferred version, the footrest moves rearwardly or retracts as the armrests move forward. This allows the user to have the armrests in a very accessible forward position when standing up or sitting down. Once seated the user can move the armrests rearward which actuates or moves the footrest forward into position. In another version, the user moves a lever, which actuates a gas spring, which moves the footrest into position. The lever can be included on the armrest or handgrip, or the lever may actually be the armrest or handgrip. In all versions of the invention, the footrest platform is easily actuated or moved into position for use without the user having to dismount the chair or without having to relocate his hands or eyes far from the tasking area.

Yet another benefit of the footrest mechanism of the present invention is derived from the ability of the mechanism to be easily accommodated by existing work chair structures. The footrest mechanism can be included as an original equipment-manufacturing feature on new chairs with the mechanism easily attached to either the chair seat or to the tilt control mechanism of the chair, which supports the chair seat. Alternatively, the footrest mechanism could be retrofitted to existing chairs with little trouble. The ergonomic footrest is attractive and inexpensive. These and other advantages of the present invention will become apparent upon inspection of the accompanying specification, claims, and drawings.

DRAWINGS

Figure 3A:
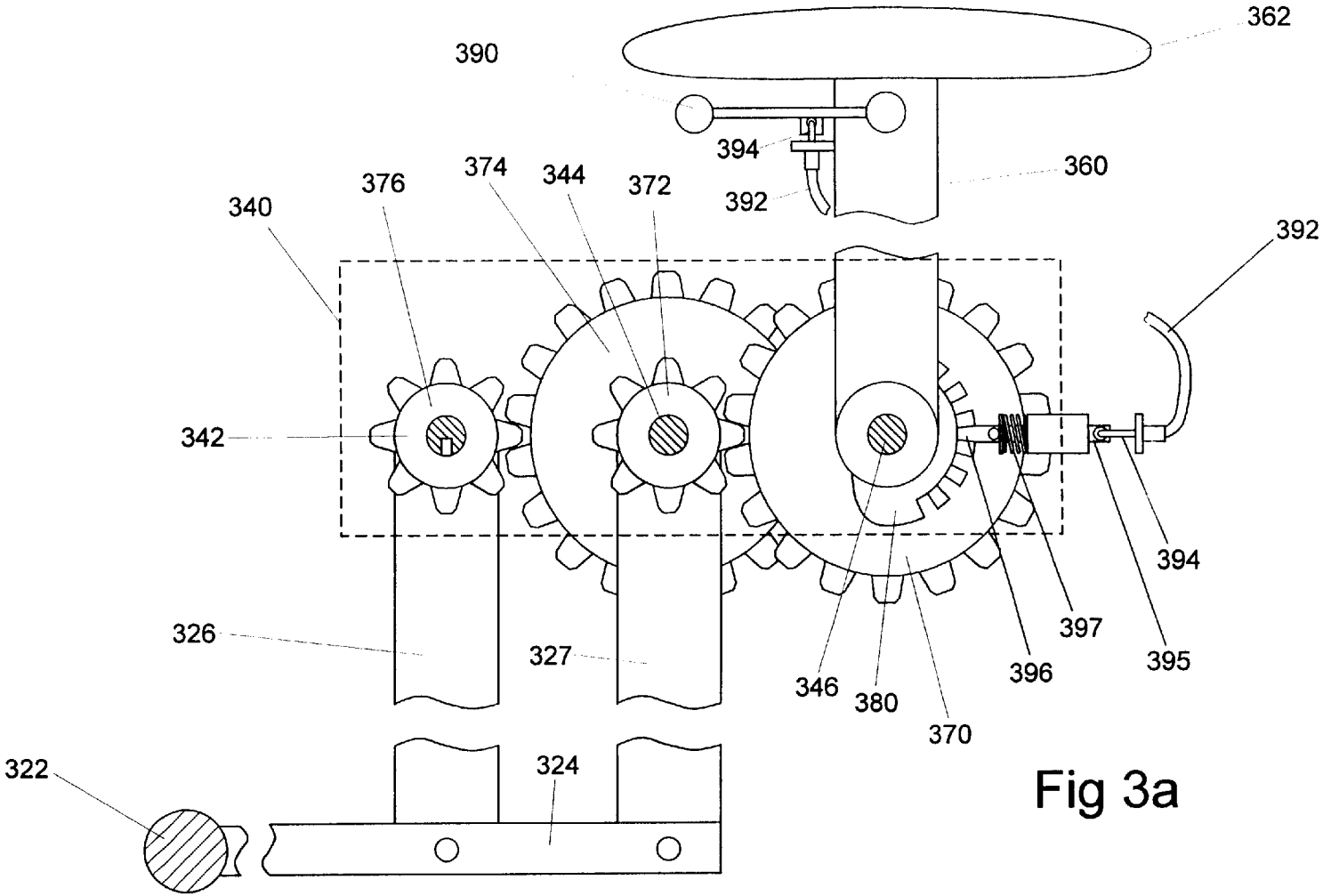

FIG. 3*a* shows a side view of a first version of the ergonomic foot rest of the present invention.

Figure 3B:
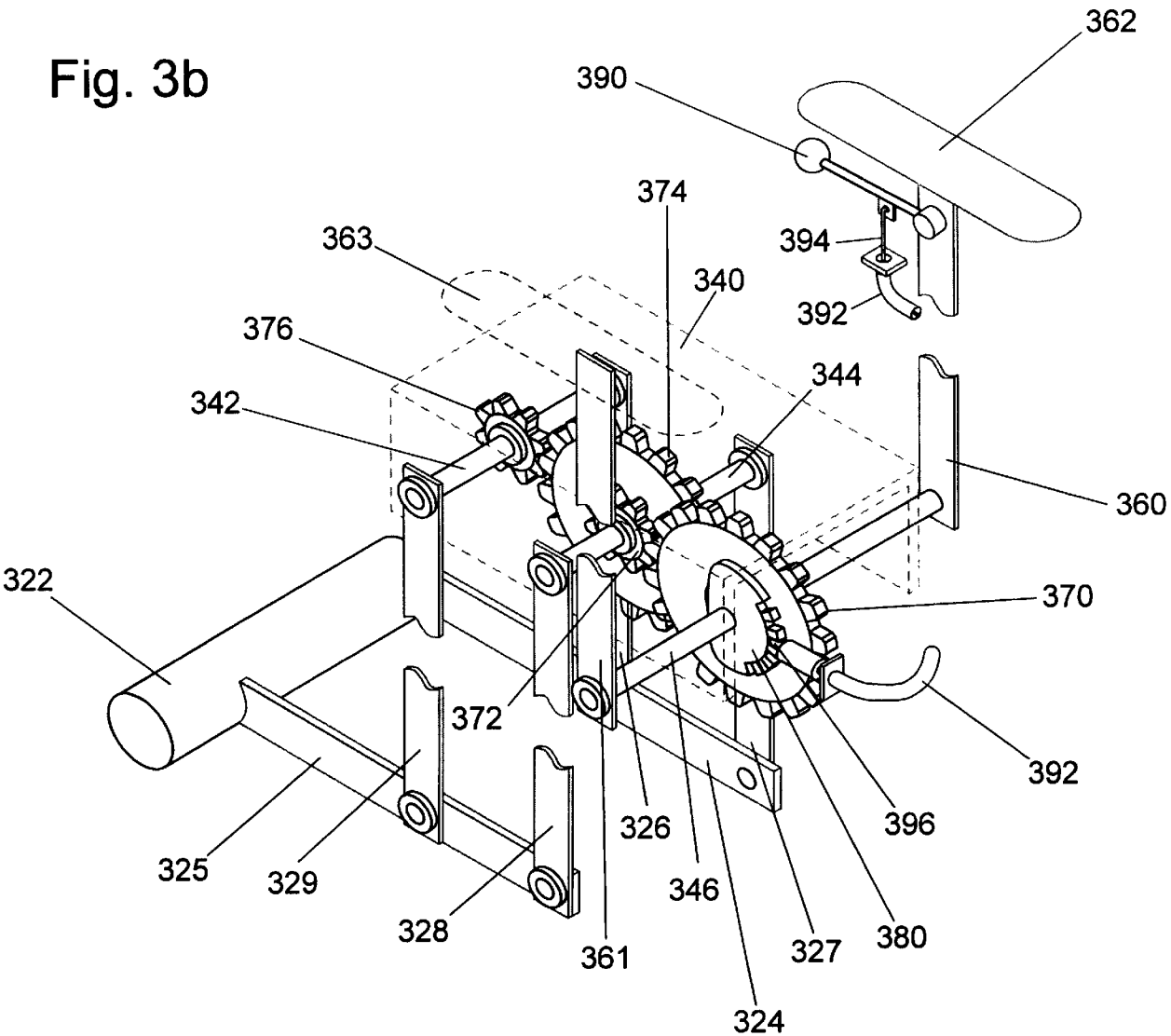

FIG. 3*b* is a perspective view of the first version of the ergonomic foot rest shown in FIG. 3*a*.

Figure 4A:
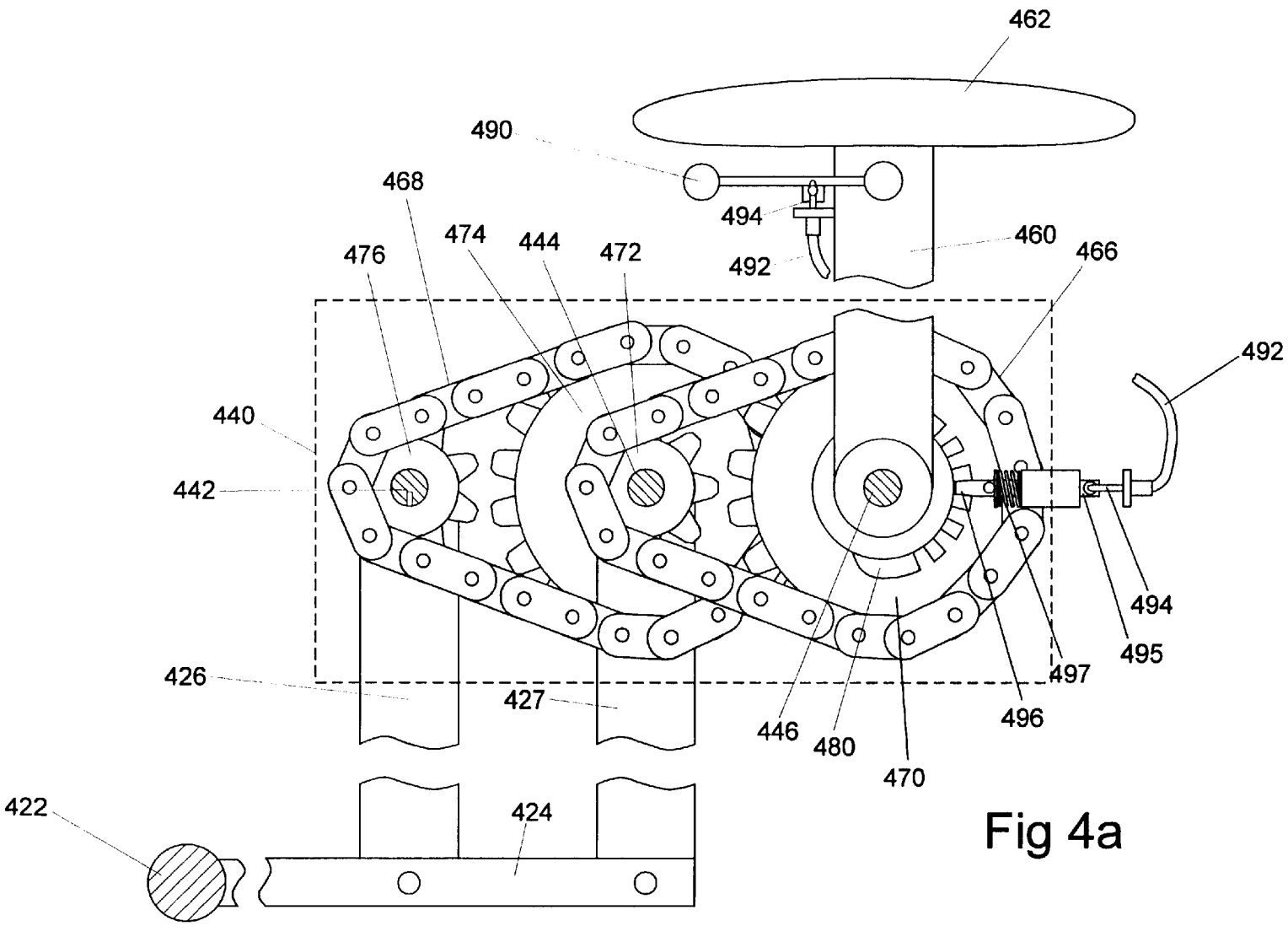

FIG. 4*a* shows a side view of a second version of the ergonomic foot rest of the present invention.

Figure 4B:
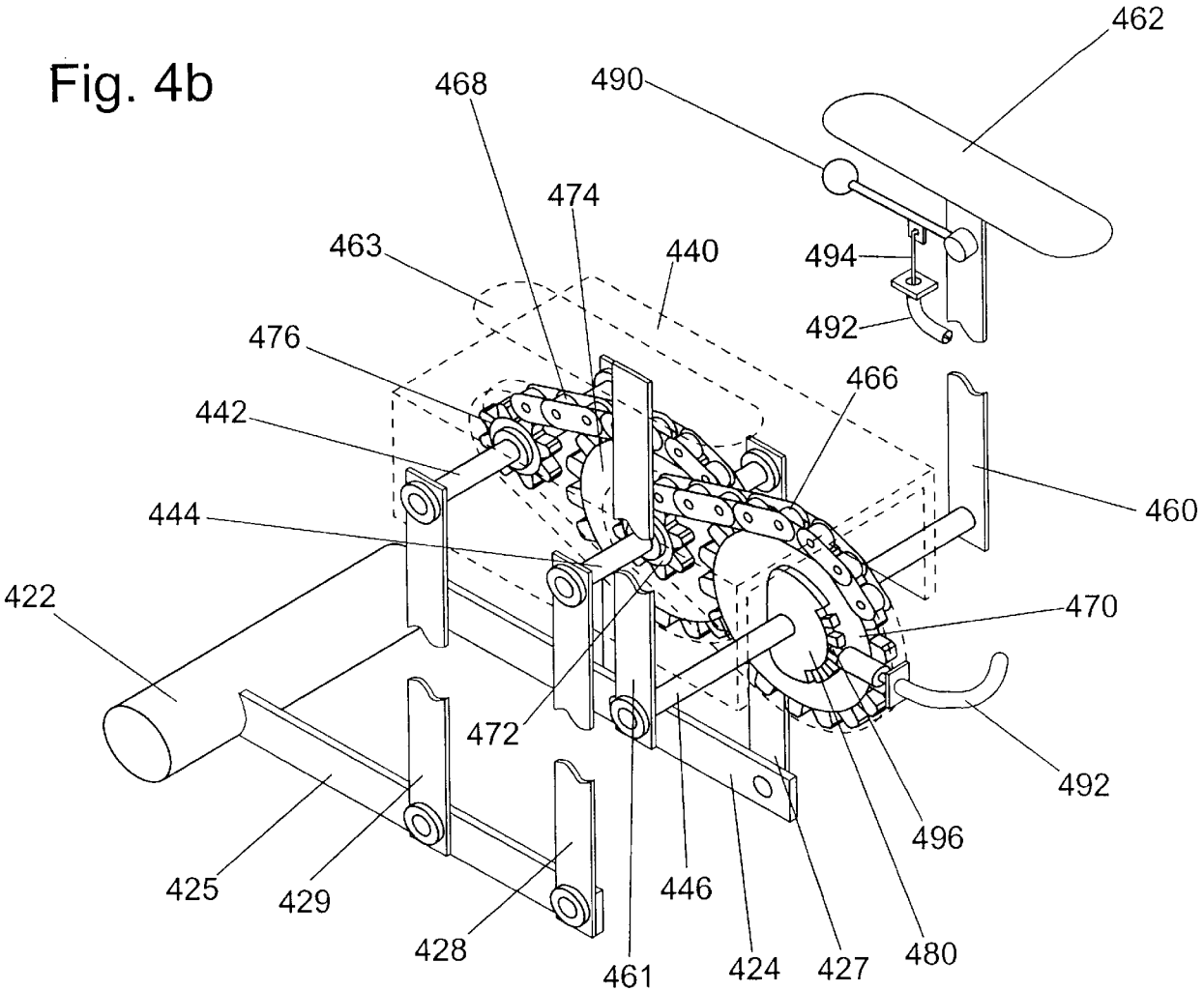

FIG. 4*b* is a perspective view of the version of the ergonomic foot rest shown in FIG. 4*a*.

Figure 5A:
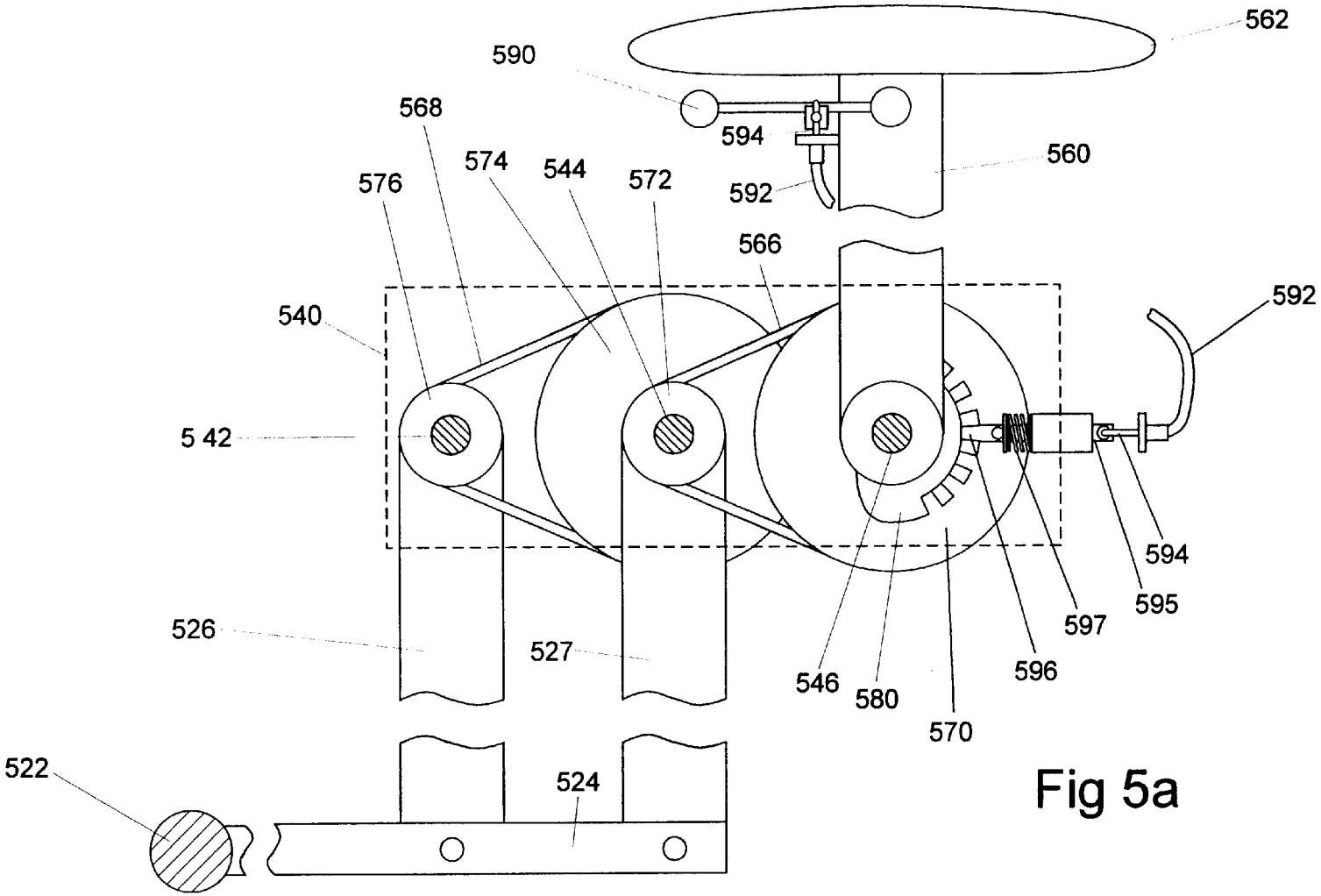

FIG. 5*a* shows a side view of a third version of the ergonomic foot rest of the present invention.

Figure 5B:
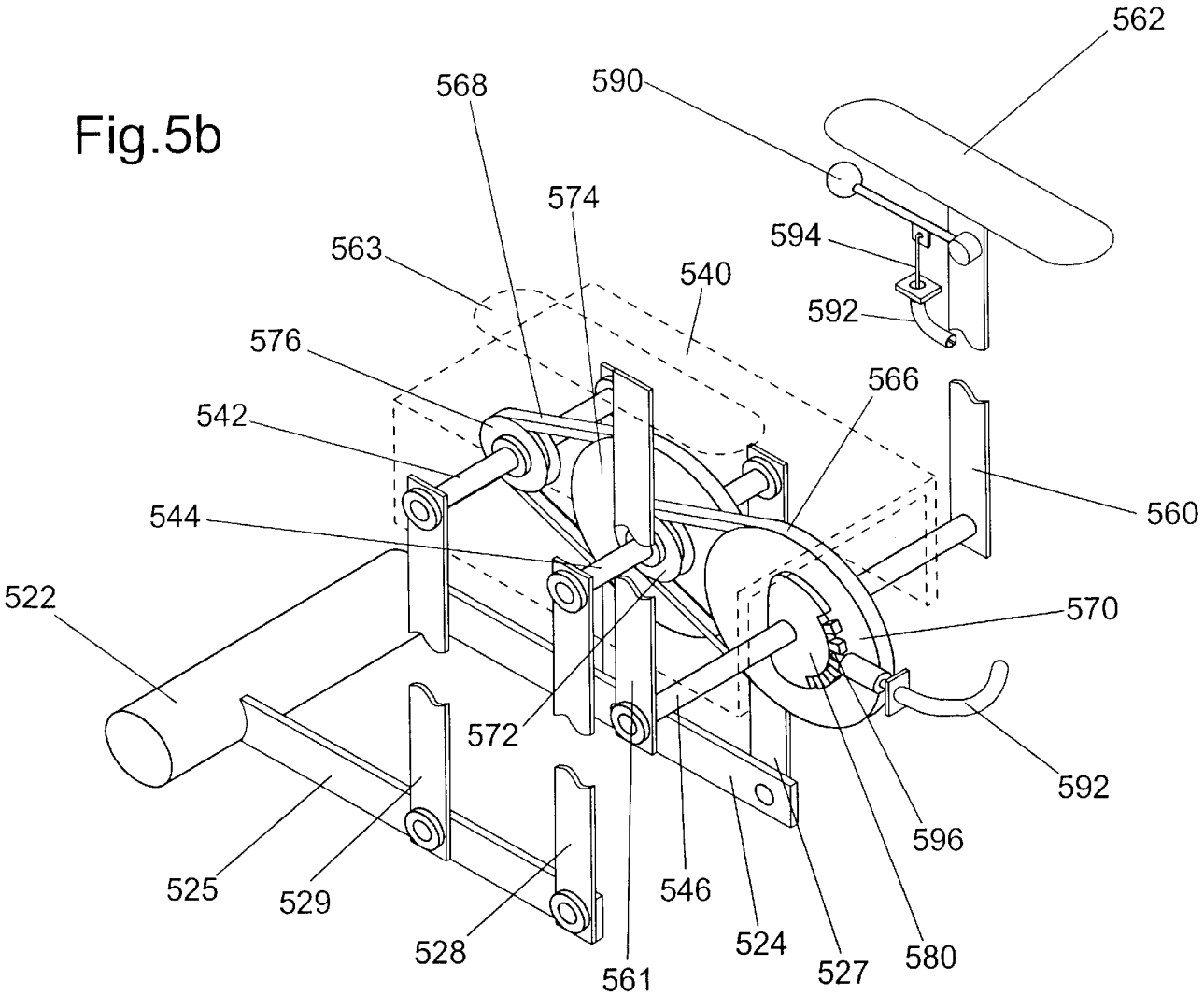

FIG. 5*b* is a perspective view of the version of the ergonomic foot rest shown in FIG. 5*a*.

Figure 6A:
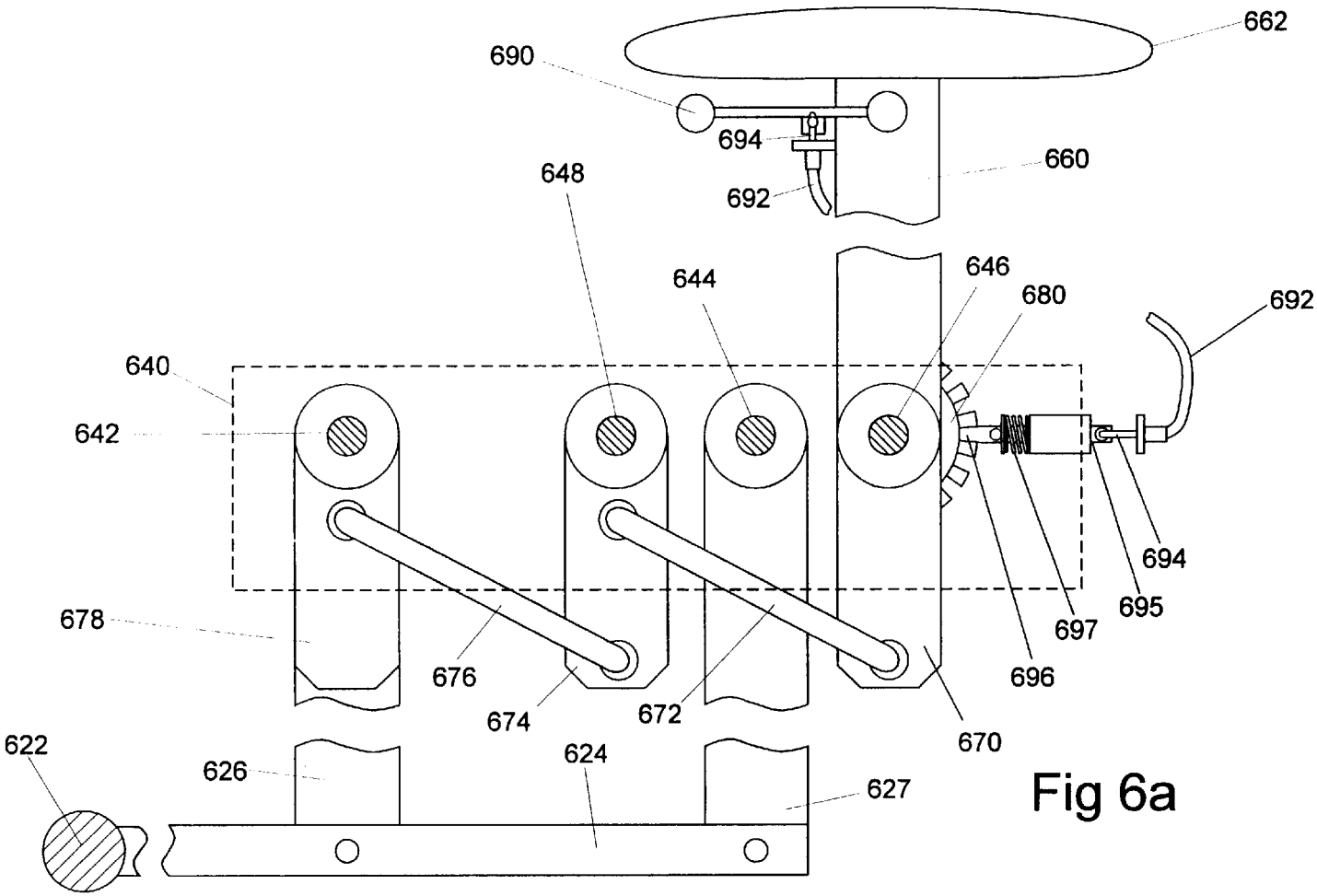

FIG. 6*a* shows a side view of a fourth version of the ergonomic foot rest of the present invention.

Figure 6B:
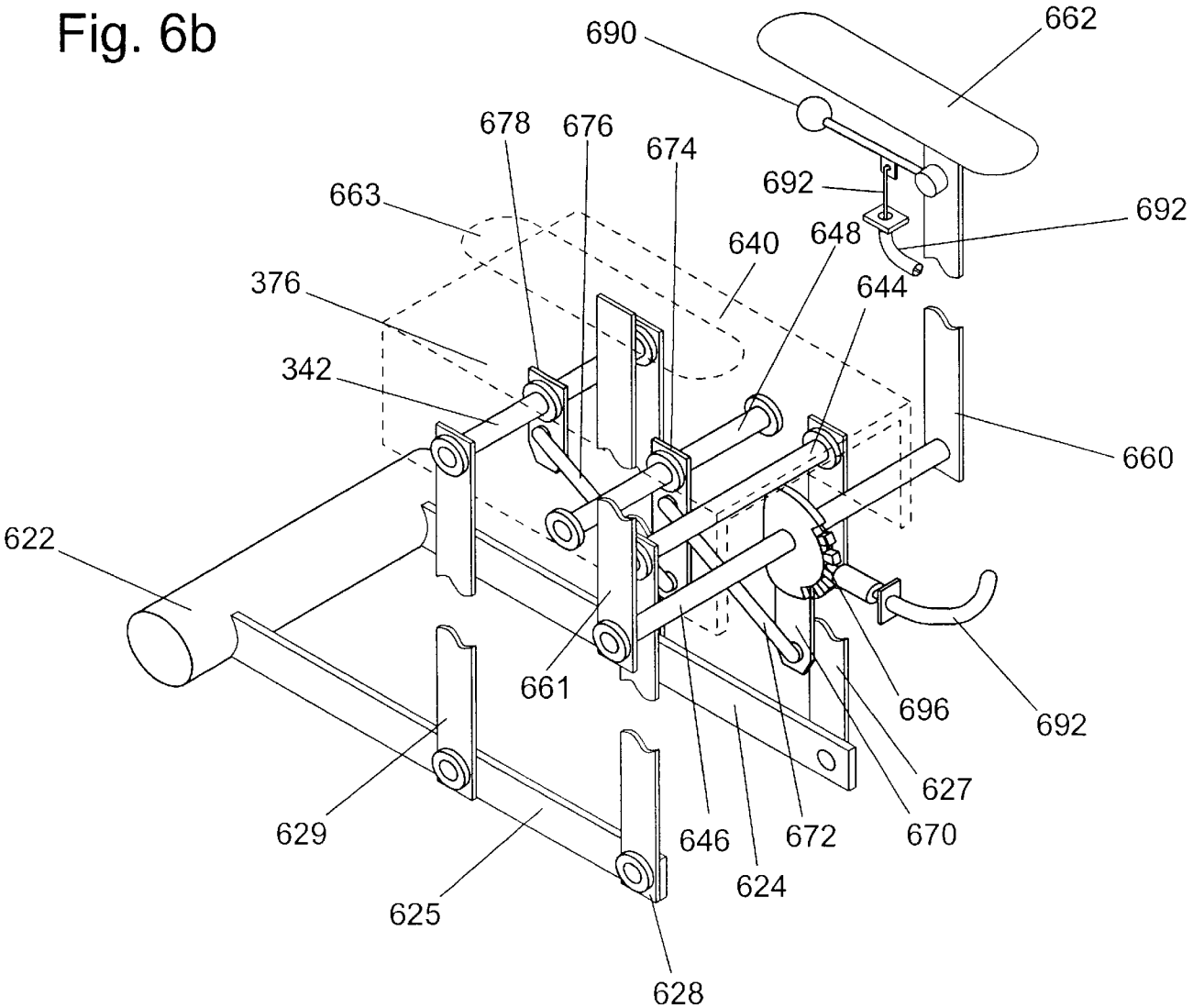

FIG. 6*b* is a perspective view of the version of the ergonomic foot rest shown in FIG. 6*a*.

Figure 7A:
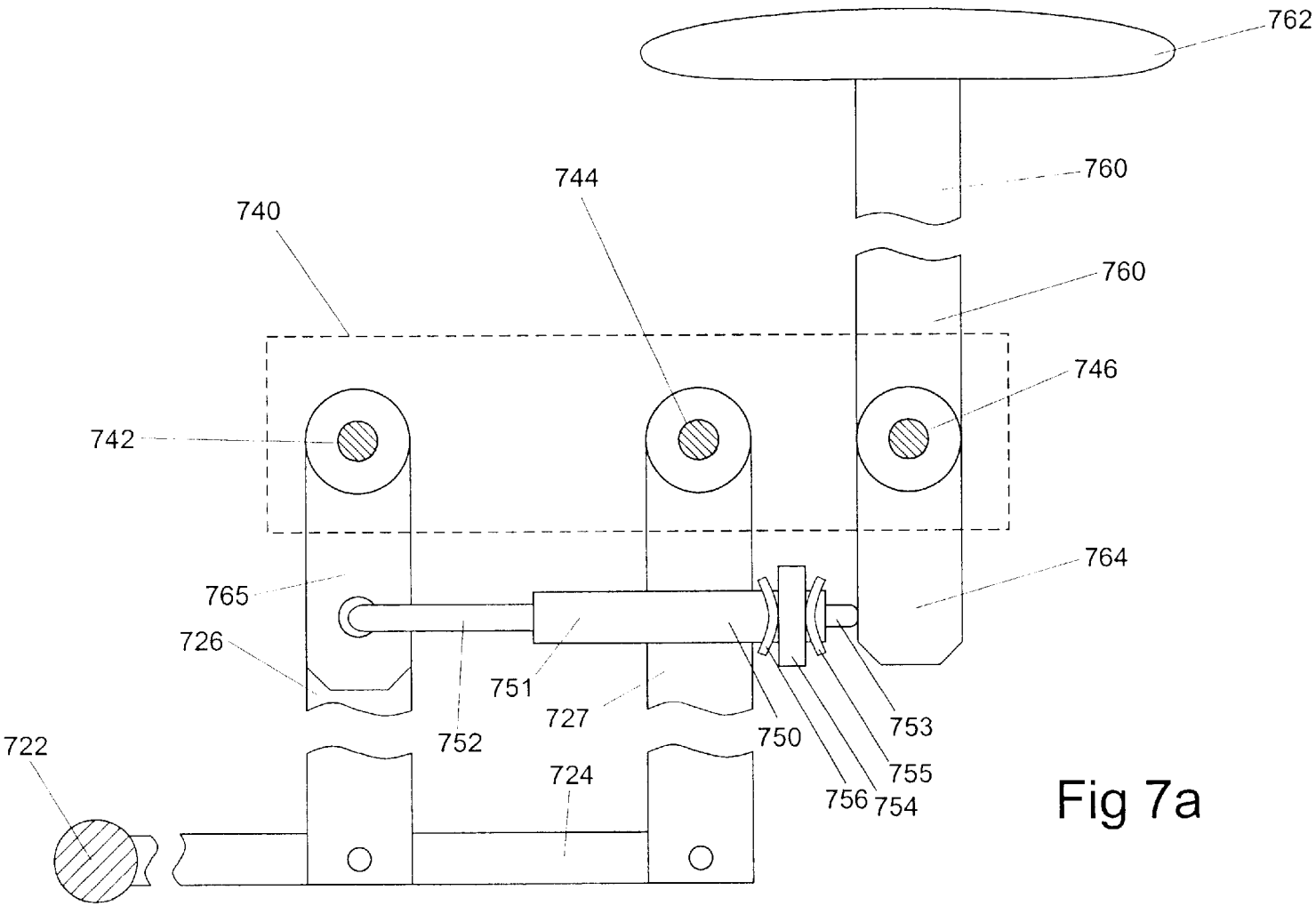
Figure 7B:
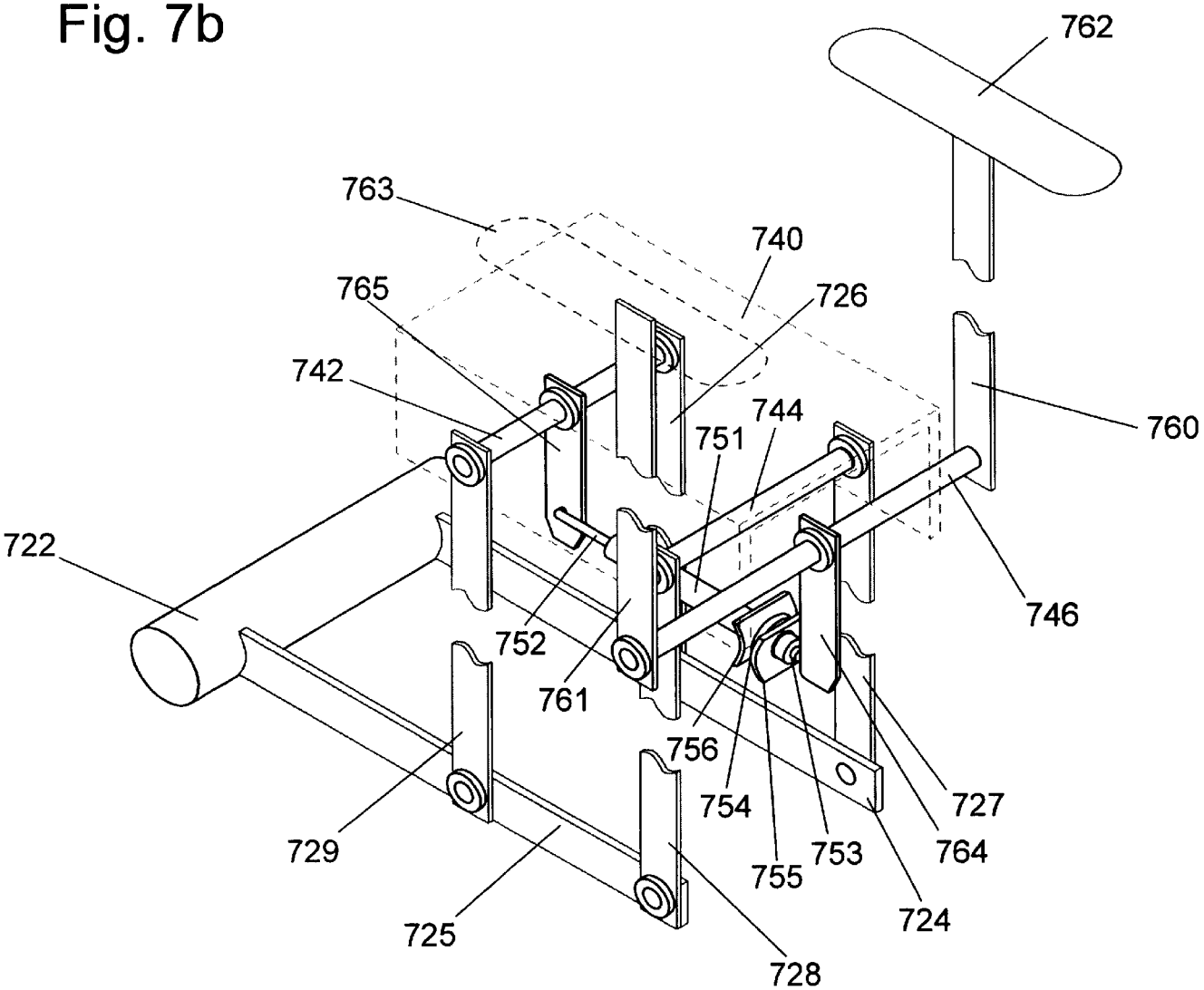

FIG. 7*a* shows a side view of a fifth version of the ergonomic foot rest of the present invention FIG. 7*b* is a perspective view of the version of the ergonomic foot rest shown in FIG. 7*a*.

Figure 8A:
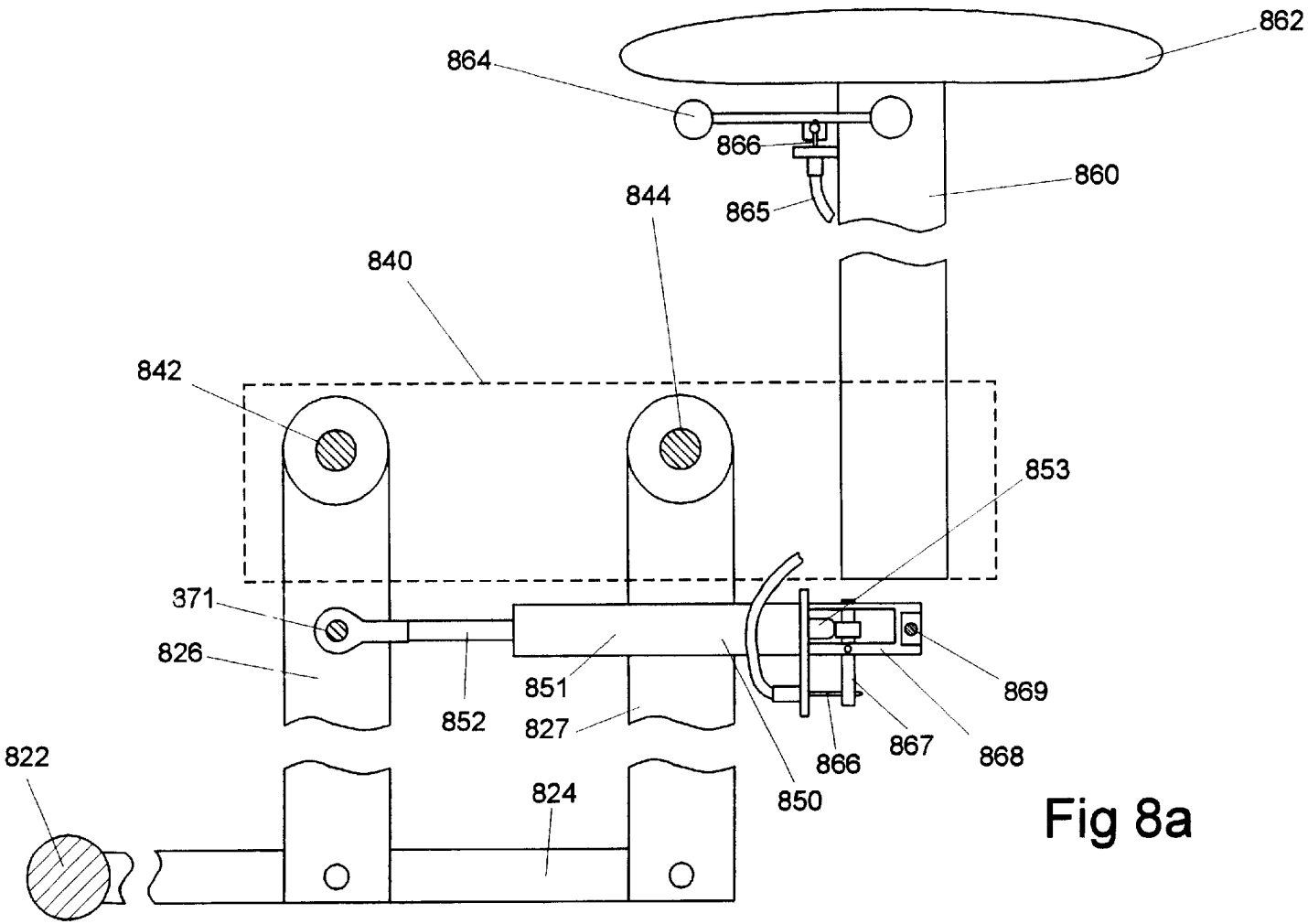

FIG. 8*a* shows a side view of a sixth version of the ergonomic foot rest of the present invention.

Figure 8B:
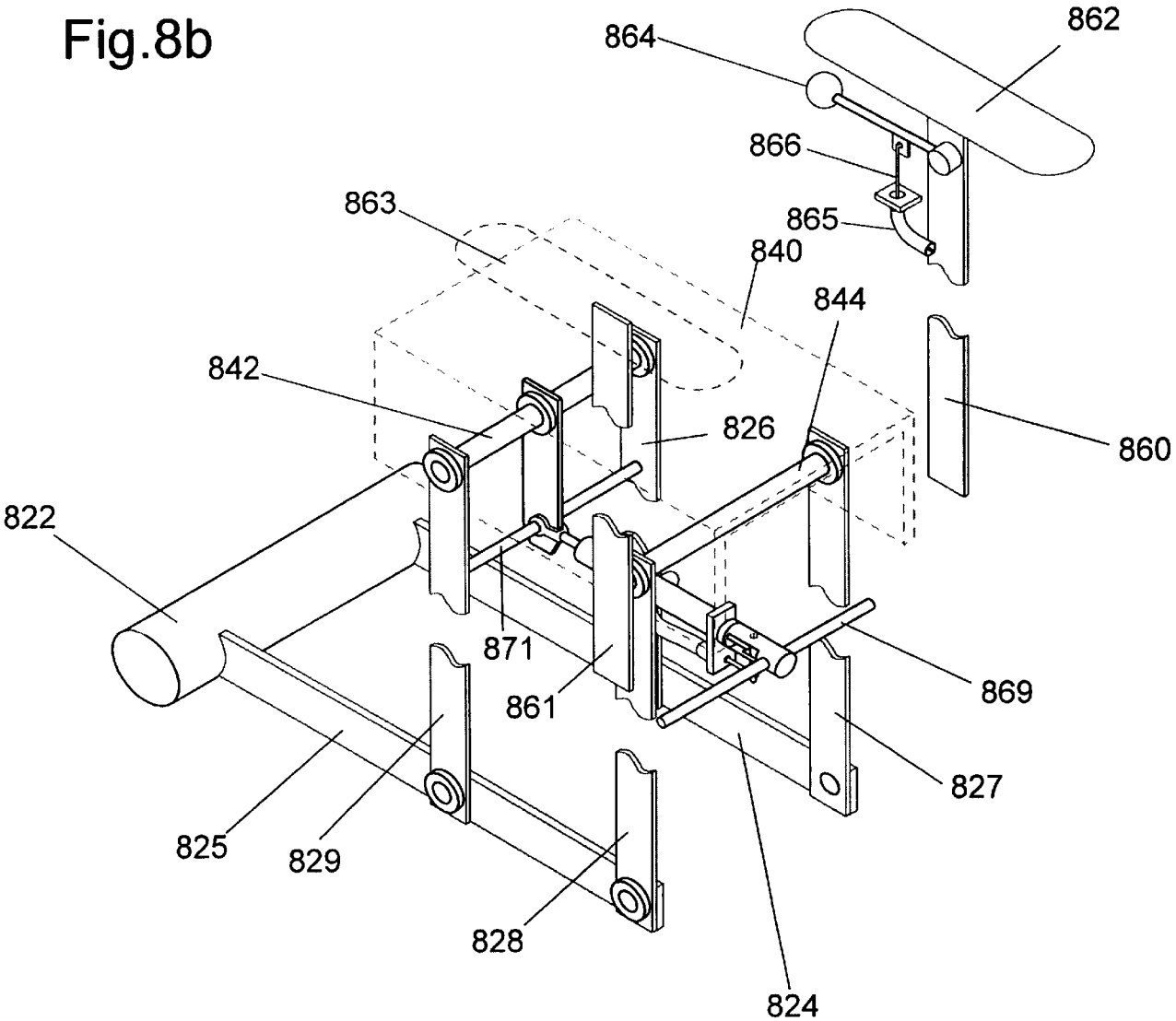

FIG. 8*b* is a perspective view of the version of the ergonomic foot rest shown in FIG. 8*a*.

Figure 9A:
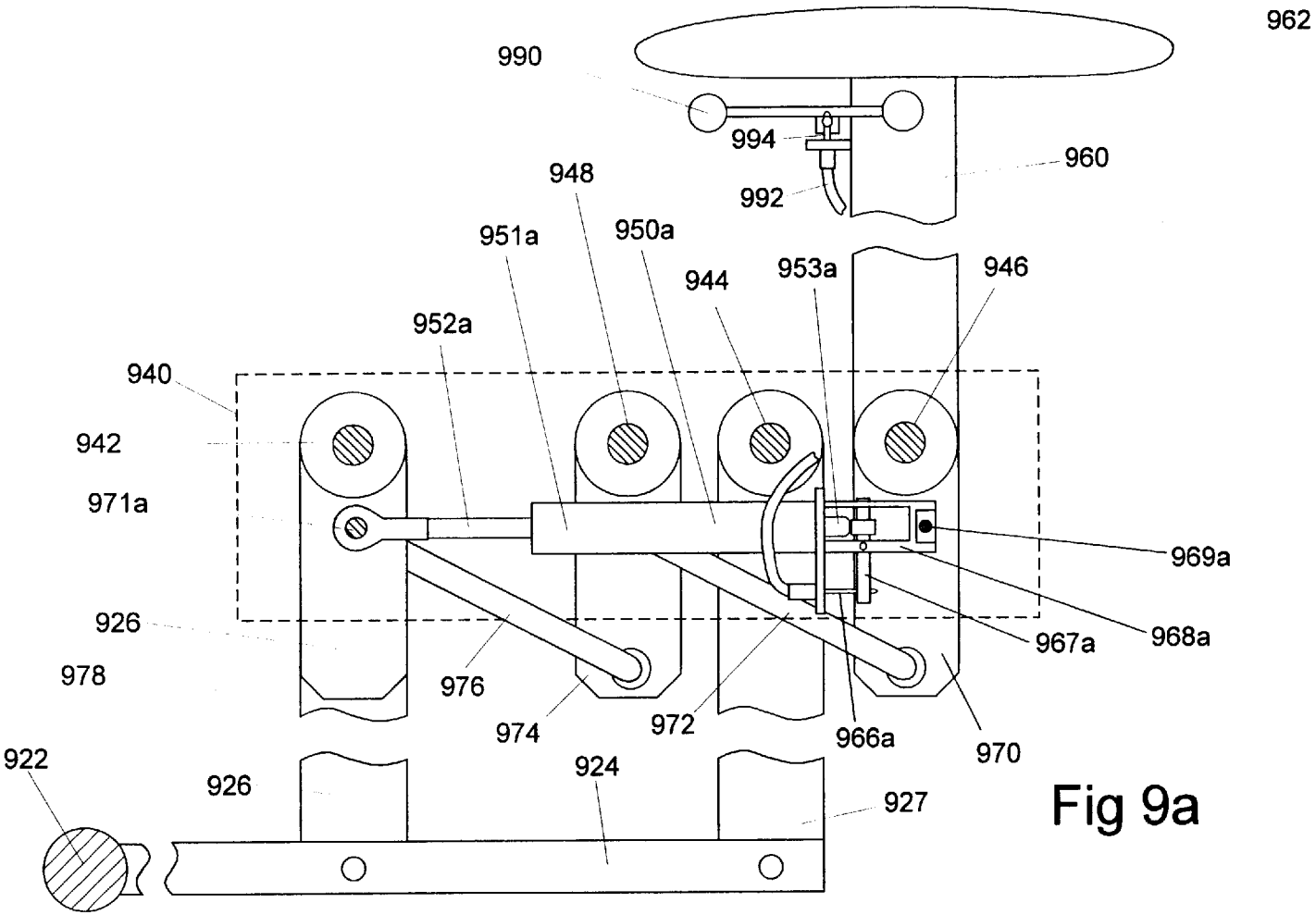

FIG. 9*a* shows a side view of a seventh version of the ergonomic foot rest of the present invention.

Figure 9B:
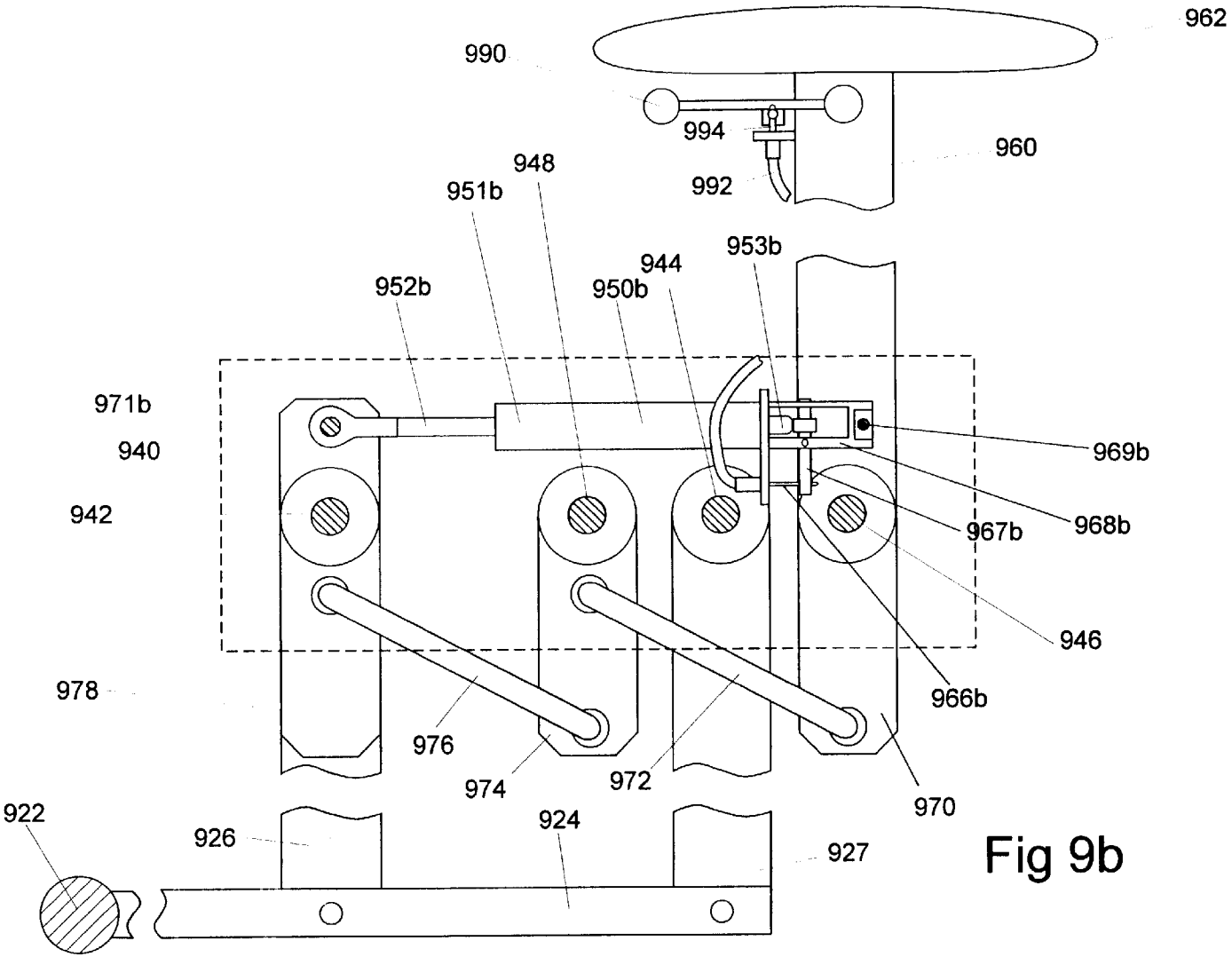

FIG. 9*b* shows a side view of a eighth version of the ergonomic foot rest of the present invention.

Figure 10A:
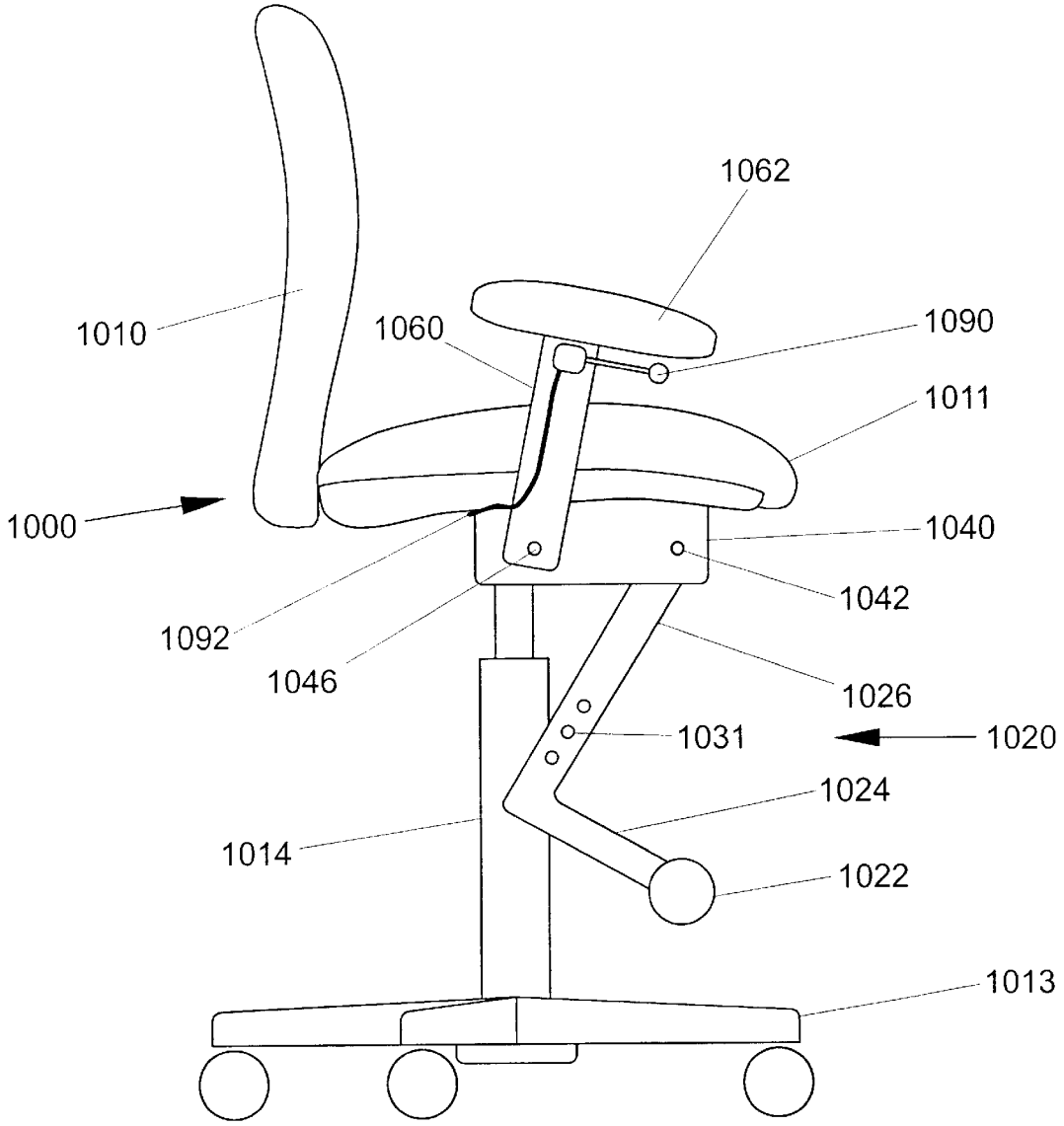

FIG. 10*a* shows a side view of a work chair including a pendulum version of the ergonomic foot rest of the present invention in an retracted position.

Figure 10B:
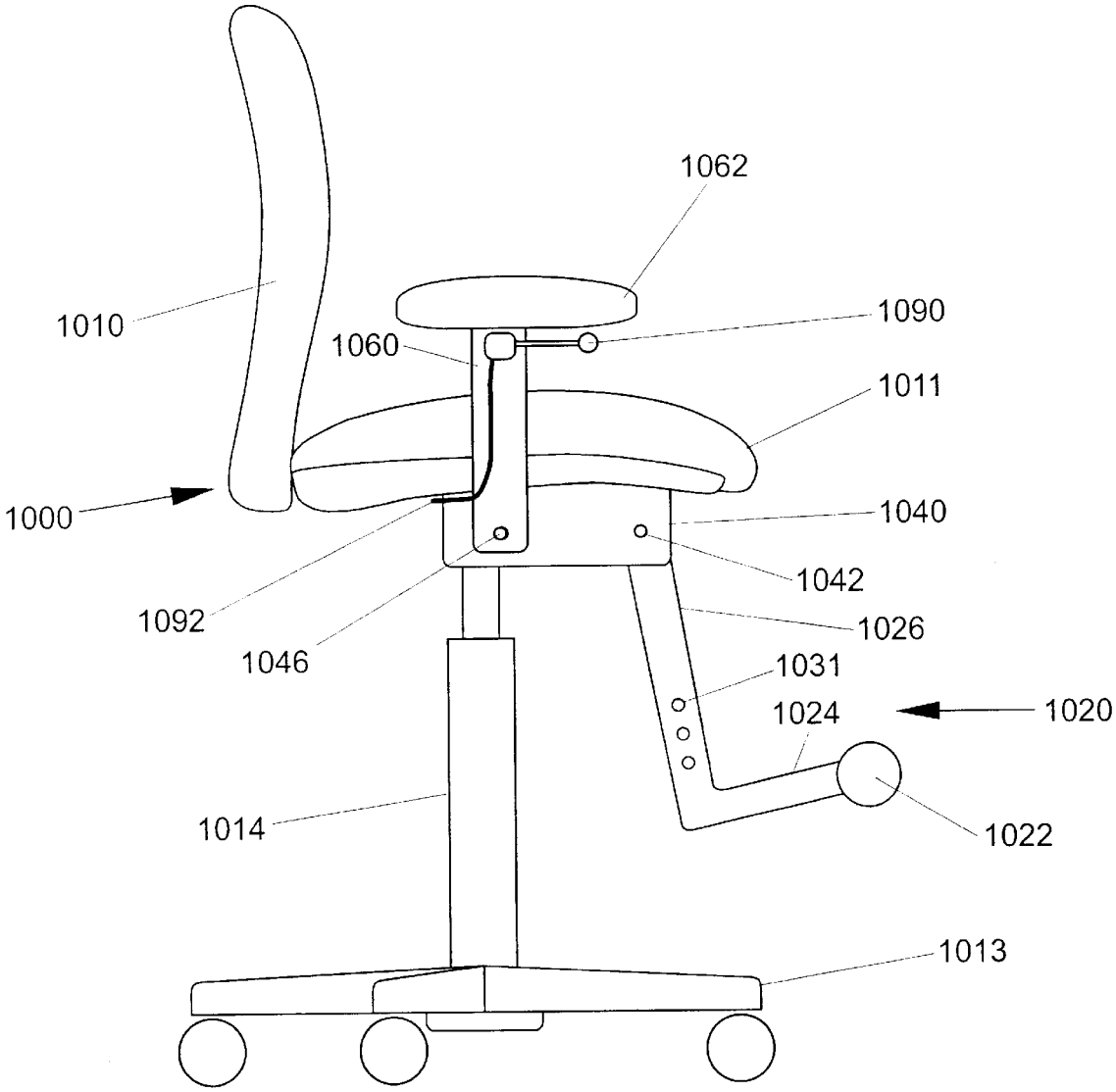

FIG. 10*b* shows a side view of a work chair including a pendulum version of the ergonomic foot rest of the present invention in an extended position.

Figure 11A:
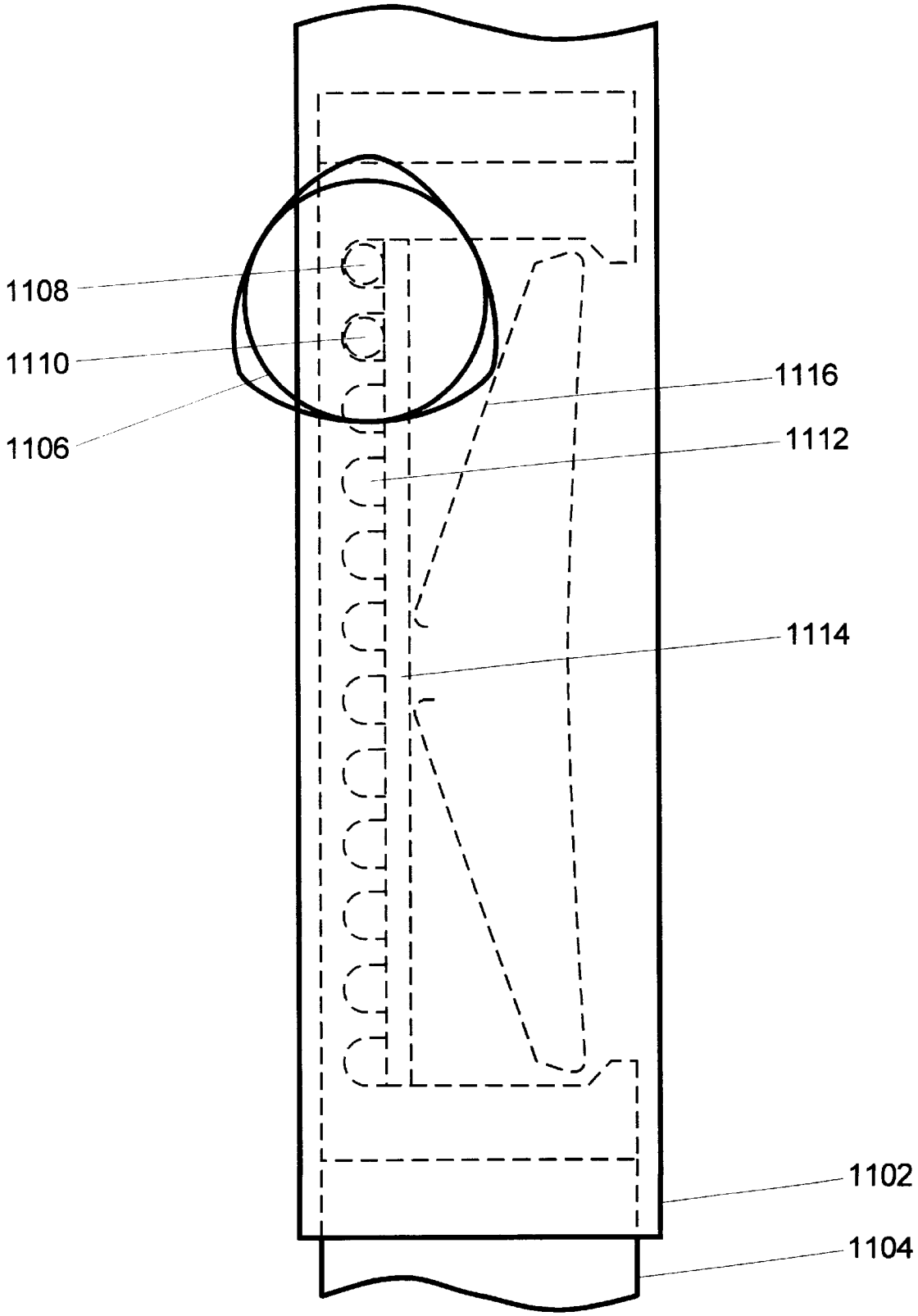

FIG. 11*a* shows a first side view of a vertical adjustment mechanism for the work chair.

Figure 11B:
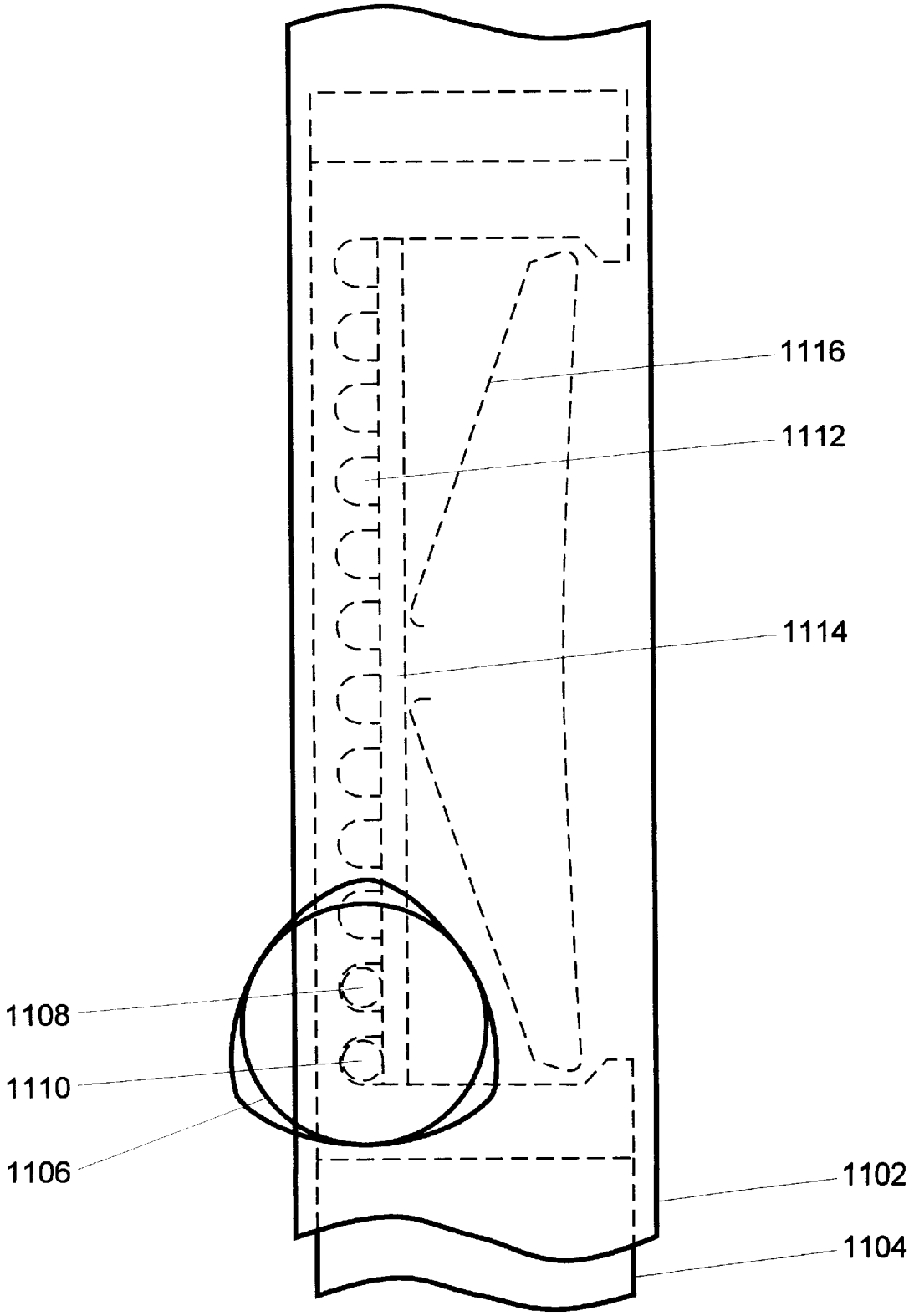

FIG. 11*b* hows a second side view of a vertical adjustment mechanism for the work chair.

Figure 12:
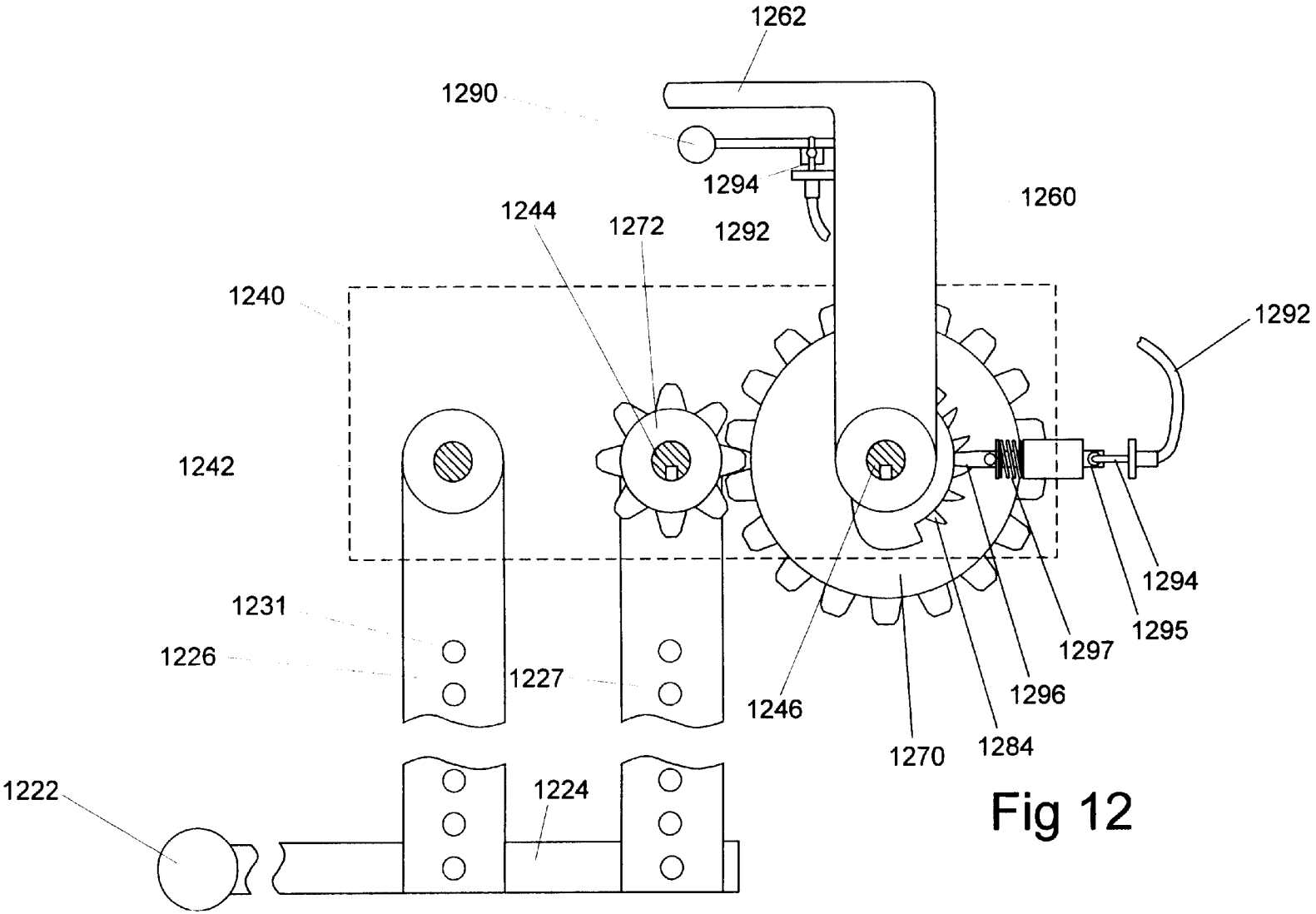

FIG. 12 shows a side view of a version of the ergonomic foot rest of the present invention.

Figure 13A:
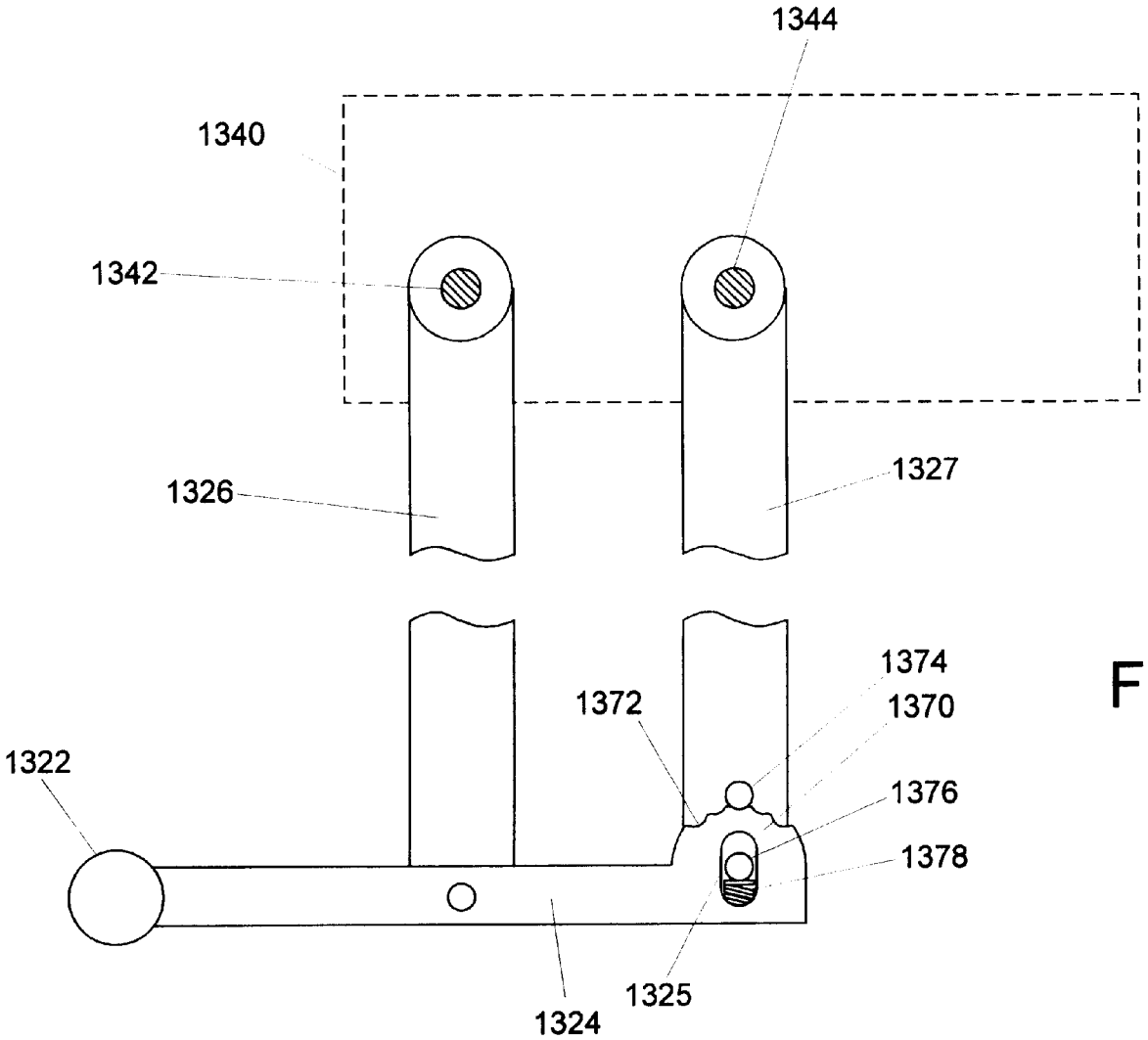

FIG. 13*a* shows a first side view of a lock mechanism for the work chair.

Figure 13B:
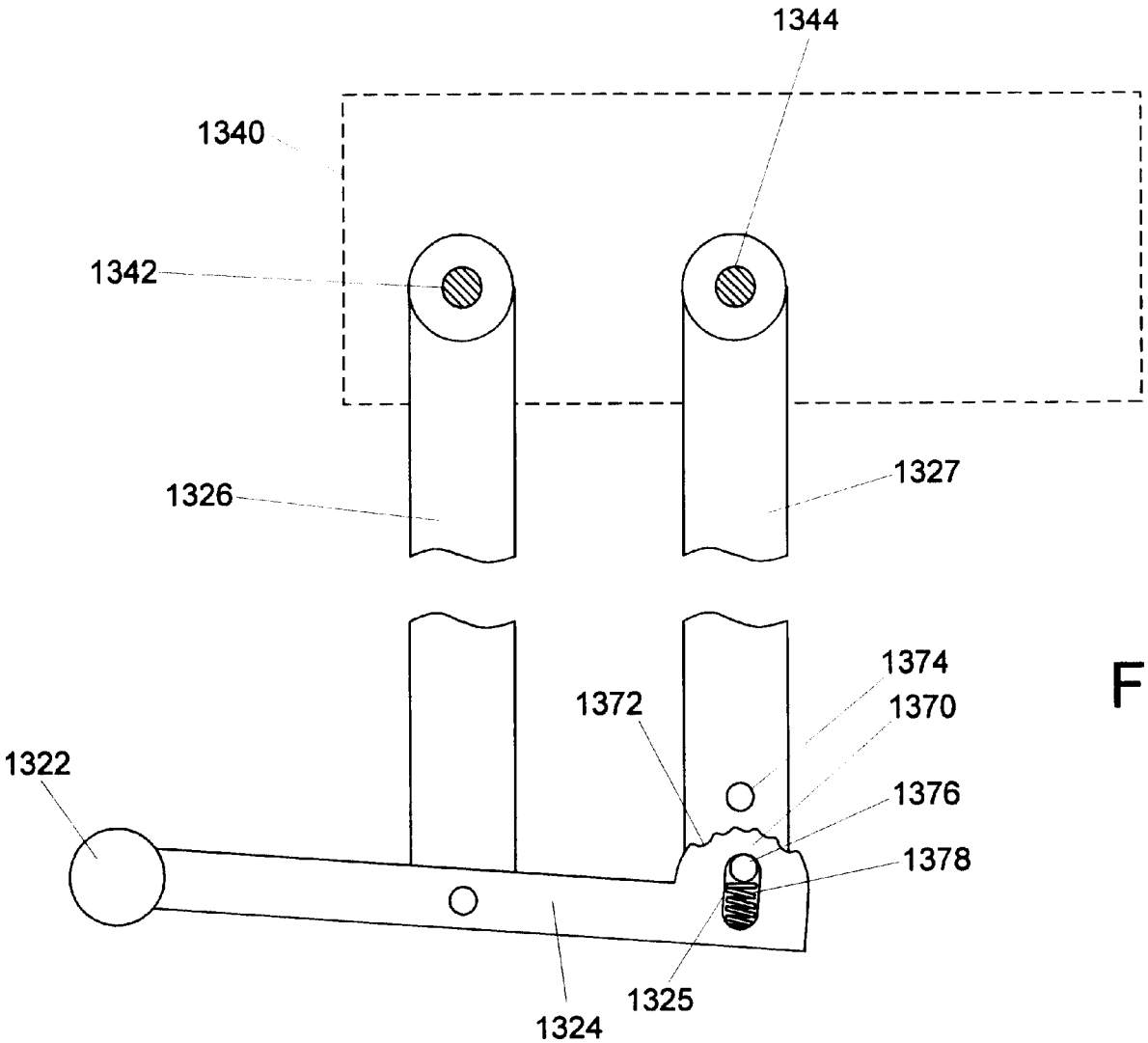

FIG. 13*b* shows a second side view of a lock mechanism for the work chair.

FIG. 14 A1 is a side view showing the desirable "bench" seating position.

FIG. 14 A2 is a side view showing the typical "bench" seating position.

FIG. 14 A3 is a side view showing the "bench" seating position enhanced by the addition of the ergonomic foot rest of the present invention.

FIG. 14 B1 is a side view showing the typical "Grandjean" seating position.

FIG. 14 B2 is a side view showing the "Grandjean" seating position enhanced by the addition of the ergonomic foot rest of the present invention.

FIG. 14 C1 is a side view showing the typical "Mandal" seating position.

FIG. 14 C2 is a side view showing the "Mandal" seating position enhanced by the addition of the ergonomic foot rest of the present invention.

FIG. 14 D1 is a side view showing the typical "Balans" seating position.

FIG. 14 D2 is a side view showing the "Balans" seating position enhanced by the addition of the ergonomic foot rest of the present invention.

FIG. 14 E1 is a side view showing the typical "center tilt" seating position.

FIG. 14 E2 is a side view showing the "center tilt" seating position enhanced by the addition of the ergonomic foot rest of the present invention.

FIG. 14 F1 is a side view showing the typical "knee tilt" seating position.

FIG. 14 F2 is a side view showing the "knee tilt" seating position enhanced by the addition of the ergonomic foot rest of the present invention.

DESCRIPTION

In greater detail, FIGS. 14 A1–F2 show the six commonly available office chair seating positions. Each position is shown as a side view, first without the addition of the ergonomic foot rest of the present invention, and second with the enhanced position that is possible by the addition of the ergonomic foot rest of the present invention. FIG. A1 shows the "bench" seating position that is desirable. The difficulty in maintaining this position were outlined in the Background. FIG. A2 shows the "bench" seating position that is typical with the back assuming a generally C-shape. Additionally, only the upper back is shown contacting the chair back rest in what is essentially non-supportive contact. FIG. A3 is a side view showing the "bench" seating position enhanced by the addition of the ergonomic foot rest of the present invention. In this enhanced position the bracing of the legs at an elevated and extended position allows the user to more easily maintain the natural curvature of the back (which is shown as a straight line in these figures).

FIGS. 14 B1 and B2 are before and after side views of the "Grandjean" seating position. This position is achieved by a rearward tilting chair back rest and a chair pan that remains horizontal. Here again, the "Grandjean" seating position is enhanced by the addition of the ergonomic foot rest of the present invention. In this enhanced position the bracing of the legs at an elevated and extended position allows the user to more easily maintain the natural curvature of the back. If the chair includes additional back rest cushioning at the location of the lower or lumbar portion of the back, the chair user would easily be able to maintain their lower back in supportive contact with this cushioning due to the bracing allowed by the enhanced foot position of the ergonomic foot rest.

FIGS. 14 C1 and C2 are before and after side views of the "Mandal" seating position. This position is achieved by a simultaneous foreward tilting of the a chair seat pan and the chair back rest The "Mandal" seating position is enhanced by the addition of the ergonomic foot rest of the present invention. In this enhanced position the bracing of the legs under the chair seat allows the user to more easily maintain the natural curvature of the back by insuring supportive contact with the chair back rest.

FIGS. 14 D1 and D2 are before and after side views of the "Balans" seating position. This position is achieved by a foreward tilting chair seat and a knee rest that tilts rearwardly back toward the chair seat The "Balans" seating position is also enhanced by the addition of the ergonomic foot rest of the present invention. In this enhanced position the bracing of the legs under the chair seat allows the user to more easily maintain the natural curvature of the back.

FIGS. 14 E1 and E2 are before and after side views of the "center tilt" seating position. This position is achieved by a simultaneous rearward tilting of the chair back rest and a chair seat pan. The "center tilt" seating position is enhanced by the addition of the ergonomic foot rest of the present invention. The foot rest also prevents the chair user from the damaging effects of dangling their legs from the chair seat as the chair tilts backward. This dangling is shown in FIG. E1. In the enhanced position provided by the foot rest of the present invention, the legs of the user are braced at an elevated and extended position. This bracing allows the user to maintain the natural curvature of the back by insuring supportive contact with the chair back rest, which would not be possible with dangling legs.

FIGS. 14 F1 and F2 are before and after side views of the "knee tilt" seating position. This position is achieved by a simultaneous rearward tilting of the chair back rest and a chair seat pan. Unlike chairs having a "center tilt" which pivots about a point roughly at the center of the seat, the "knee tilt" chair pivots about a point at the front of the seat pan proximate to the location of the user's knees. This pivot location allows the user's feet to remain in contact with the floor when the chair user reclines in the chair. The "knee tilt" seating position is also enhanced by the addition of the ergonomic foot rest of the present invention. In this enhanced position the bracing of the legs at an elevated and extended position allows the user to more easily maintain the natural curvature of the back by insuring supportive contact with the chair back rest.

Figure 1:
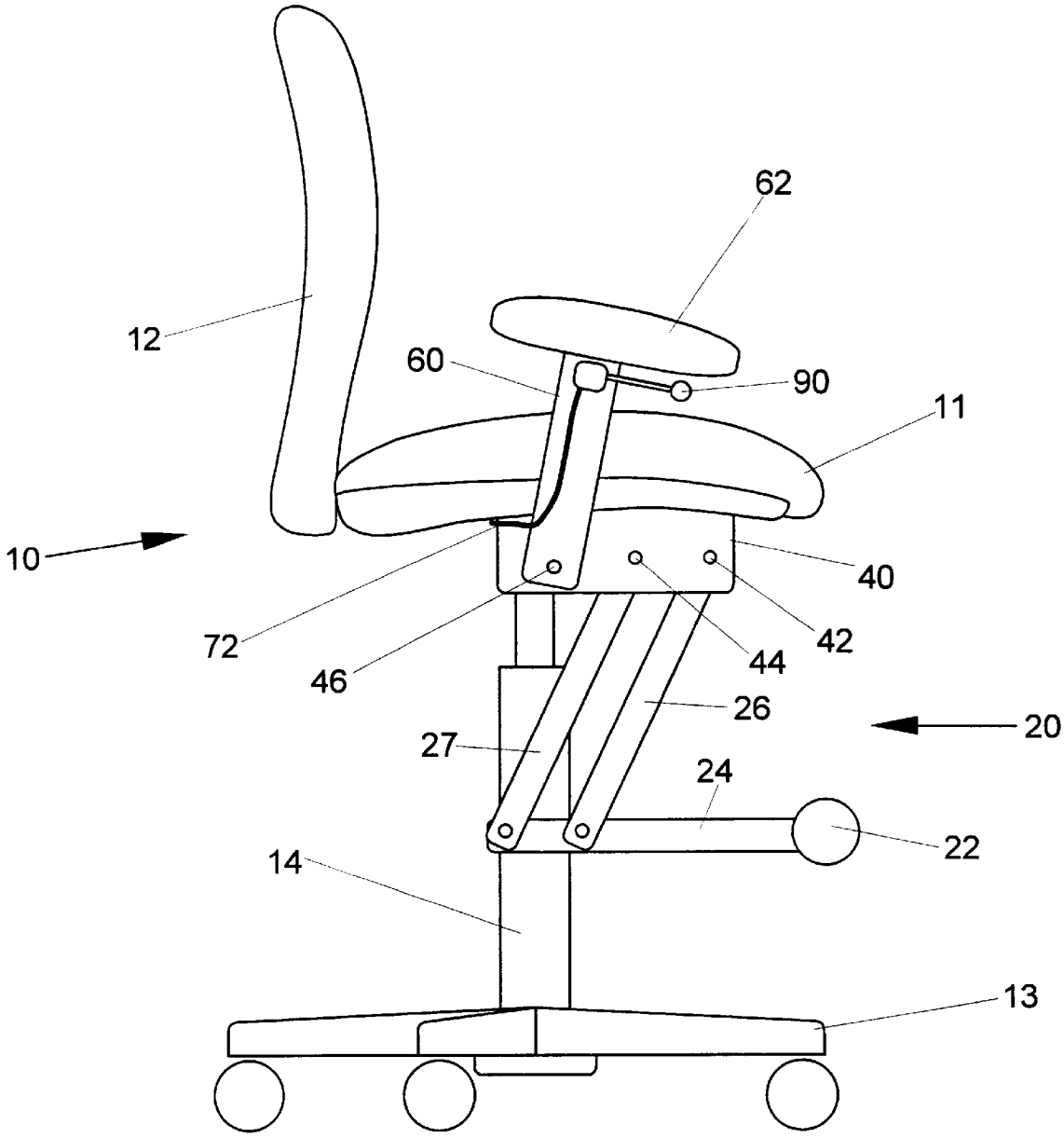
FIG. 1 shows a side view of a work chair including a version of the ergonomic foot rest of the present invention in an retracted position.
Figure 2:
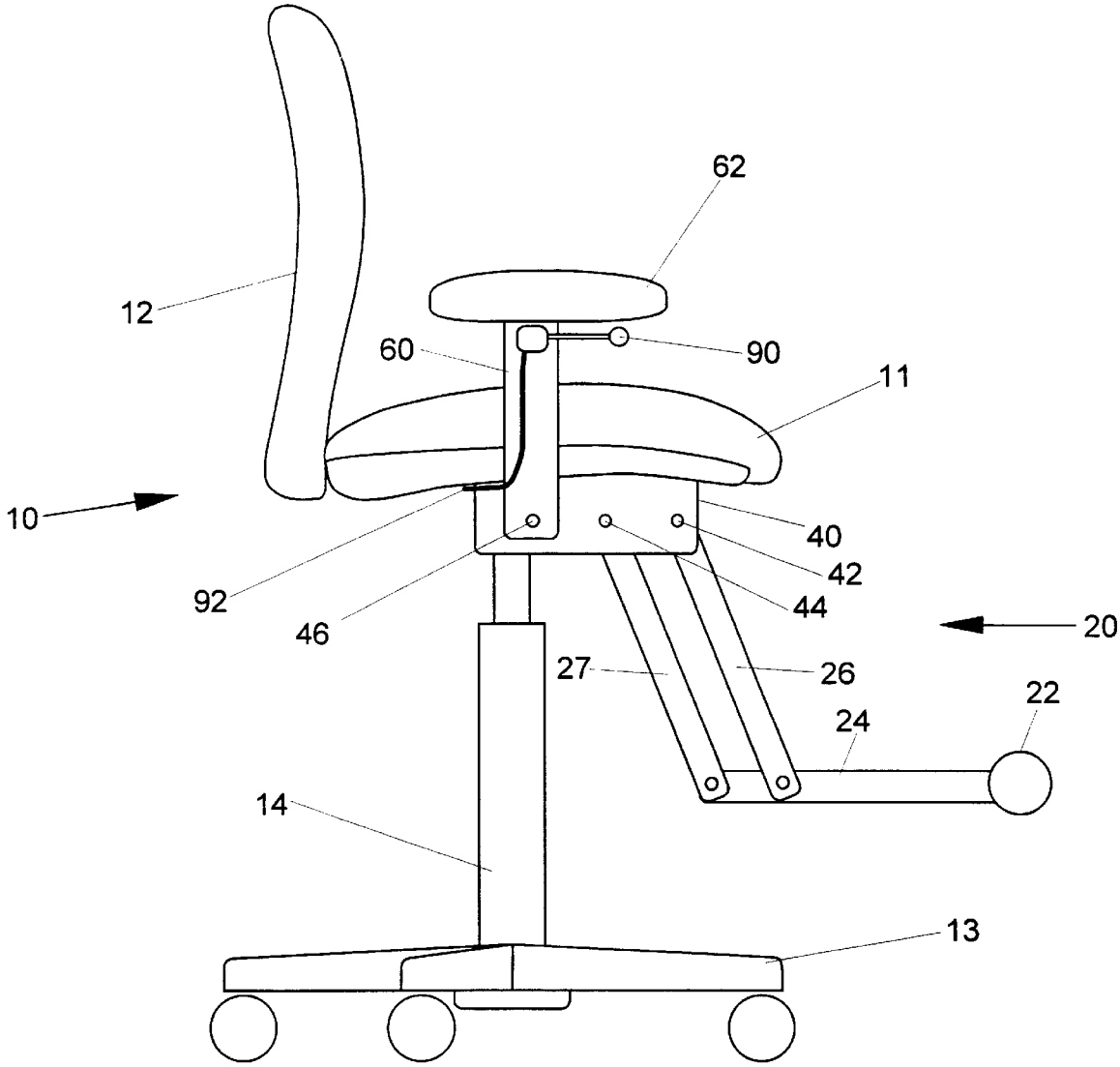
FIG. 2 shows a side view of a work chair including a version of the ergonomic foot rest of the present invention in an extended position.

Briefly, FIGS. 1 and 2 show side views of a work chair including the ergonomic foot rest of the present invention. FIG. 1 shows the foot rest brace of the ergonomic foot rest in a fully retracted position under the chair seat. FIG. 2 shows the foot rest brace in a fully extended position which places the user's feet in an elevated and extended position.

In greater detail, FIG. 1 shows a work chair 10 which comprises a seat 11, a back rest 12, a base 13 and a vertically adjustable pedestal 14 which supports the seat in an elevated position relative to the base 13. Attached to the work chair 10 is an ergonomic foot rest shown generally at 20. The ergonomic foot rest 20 includes a foot rest brace 22, which is attached to the chair seat in this version by a pivoting parallelogram structure which includes a first pair of parallel foot rest platform support arms 26 and 27. The foot rest brace 22 and the pivoting parallelogram structure comprise a foot rest mechanism for the ergonomic foot rest 20.

The pivoting parallelogram structure is pivotally attached to a foot rest actuating mechanism which in the version shown in this figure comprises an arm rest assembly comprising an arm rest lever 60 and an arm rest 62. The foot rest actuating mechanism is supported for rotational movement by an attachment plate means 40. The chair attachment means 40 comprises a channel shaped bracket. Attachment means 40 is secured to either the bottom of the chair seat or to a chair tilt control mechanism which would also be attached to the bottom of the chair seat. Alternatively, the attachment means could be incorporated directly into the chair tilt control mechanism.

The arm rest lever 60 is connected to a foot rest actuating lever shaft 46 which is secured to the chair attachment means 40. Rotational movement of the actuating lever shaft 46 causes the upper ends of two foot rest platform support arms 26 and 27 to also move rotationally in relation with the chair attachment means 40. This movement of the actuating lever shaft is translated to the support arms through a drive mechanism which is not shown in this figure. In this version of the invention, a rearward rotational movement of the arm rest lever 60 will cause the foot rest brace 22 to move both forward and upward. The pivoting parallelogram actually moves in a forward and upward manner known as curvilinear translation. In FIG. 1, the arms are shown in a forward position which has moved the foot rest brace 22 into a rearward retracted position under the chair seat 11.

FIG. 2 shows the foot rest brace 22 moved into a forward position which would place the feet into a position which is both extended and elevated relative to the typical foot position on the floor. In this figure, the arm rest 62 has been moved rearward in relation to the chair seat 11. This rearward movement of the arm rest rotates the actuating lever shaft 46 counterclockwise which in turn rotates the pivotally attached upper ends of the support arms 26 and 27, as well. The translation of this rotational movement is accomplished through the drive means. Thus, this rotational movement of the upper ends of the support arms causes the support arms to move forwardly in relation to the chair seat to the elevated and extended foot rest position.

FIGS. 3*a*, 4*a*, 5*a*, 6*a*, 7*a*, 8*a*, 9*a*, and 9*b* are side views of different versions of the ergonomic foot rest 20 of the present invention. In particular, these figures show different versions of drive mechanisms that may be utilized in the ergonomic foot rest 20 of the present invention. FIGS. 3*b*, 4*b*, 5*b*, 6*b*, 7*b*, and 8*b*, are perspective views of the side views of FIGS. 3*a*, 4*a*, 5*a*, 6*a*, 7*a*, and 8*a*. FIGS. 9*a*, and 9*b* are side views each showing a drive mechanism comprising two drive mechanism components shown in the previous figures. As will become clear from the following description, these different versions of the invention share many of the structural and functional features which embody the spirit of the invention.

Briefly, FIG. 3*a* shows a first version of the ergonomic foot rest that includes a first version of the drive mechanism for the foot rest actuating mechanism. This first version of the drive mechanism includes a compound gear train. The figure is a partial side view with a number of elements shown in cross section. For clarity, only the elements that are part of the ergonomic foot rest are shown. Accordingly, the chair elements that were shown in FIGS. 1 and 2 are not included in this figure. These chair elements have also been excluded in the figures which follow that show similar views of additional versions of the invention.

In greater detail, FIG. 3*a* shows the ergonomic foot rest comprising a foot rest mechanism that includes a foot rest brace 322 and a first pair of parallel support arms 326 and 327. The support arms are supported for rotational movement by drive shafts 342 and 344. Drive shafts 342 and 344 are part of a gear driven drive mechanism which includes gear 370, 372, 374, and 376. Gears 370, 372, 374, and 376 are assembled into a compound gear train. The drive mechanism, which includes the compound gear train, is part of a foot rest actuating mechanism which additionally includes arm rest lever 360 and arm rest 362. Arm rest lever 360 is pivotally attached to the actuating lever shaft 346. Accordingly, rotation of the arm rest 362 is translated through the arm rest lever 360 to the actuation lever shaft 346. Also supported on actuating lever shaft 346 is gear 370 which will rotate upon the rotation of actuating lever shaft 346. The rotation of gear 370 is translated to shaft 342 through the gear train. Gear 370 will transfer a rotational movement to gear 372 through the engagement of gear teeth. Gear 372 is attached to shaft 344 so that rotation of gear 372 will cause a further rotation of gear 374 which is also attached to the shaft 344. Gear 374 will transfer rotational movement to gear 376, also through the engagement of gear teeth. The rotational movement of gear 376 will further rotate drive shaft 342 which will transfer rotational movement to the support arm 326 which is secured to the drive shaft through a key mechanism or other suitable means.

The rotational movement of the support arm 326 further causes the movement of foot rest brace 322. The foot rest brace 322 is attached to the support arm 326 through a bottom support arm or strut 324. Strut 324 is further secured to the bottom of support arm 327. Support arm 327 hangs freely from shaft 344 and completes a supporting parallelogram which restricts the movement of foot rest brace 322 to a path known as curvilinear translation.

As can be seen in the figure a forward rotation of arm rest 362 is translated through the drive mechanism to cause a rearward movement of the foot rest brace. This forward rotation of the arm rests is used to retract the foot rest mechanism into the position that was shown in FIG. 1. The forward position of the arm rests allows for an easy entry into the chair seat as the arm rests are close to the user's body in this forward position. A rearward movement of arm rest 362 is translated through the drive mechanism to cause a forward movement of the foot rest brace. This rearward movement of the arm rests is used to extend the foot rest mechanism into the elevated and extended foot position that was shown in FIG. 2.

The compound gear train is, of course, for the purposes of translating a small rotational movement of the arm rest to a larger movement of the foot rest brace. Although a compound gear train is shown, it is understood that the gear train could also comprise a first gear 370 which would directly engage and drive gear 376 which would eliminate the intermediate gears 372 and 374 of the gear train. Also possible is the replacement of gears 372 and 374 by an intermediate idler gear which would reverse and translate rotational movement of the gear 370 to the front gear 376.

The ergonomic foot rest is supported on the chair by a chair attachment means 340 shown in dotted lines. In particular, shafts 342, 344, and 346 are typically supported by the chair attachment means by suitable means such as bearings or bushings which permit rotation of the shafts in relation to the chair attachment means 340.

FIG. 3*a* further shows a locking mechanism comprising a spring actuated plunger which includes a plunger head 396 which engages teeth of gear 380. The plunger is disengaged from the gear by a cable actuation mechanism that includes a lever 390 which pulls cable 394 through a cable housing 392. The cable is further attached to the plunger end 395 which is opposite the plunger head 396. Releasing the lever 390 allows the spring 397 to urge the plunger head into engagement with the gear 380. The locking mechanism restricts movement of the foot rest brace 322 while the plunger head 396 is engaged to the teeth of gear 380.

FIG. 3*b* shows the entire ergonomic foot rest in perspective. As shown, the foot rest mechanism includes two pairs of parallel support arms 328 and 329, as well as the earlier described 326 and 327. Support arms 328 and 329 are also attached to the foot rest brace 322 through the strut 325. Accordingly, the foot rest mechanism of the ergonomic foot rest includes two parallelogram support structures which are secured to opposite ends of the foot rest brace 322.

Also shown in FIG. 3*b* is the inclusion of a second arm rest 363 and arm rest lever 361 which are included in the foot rest actuating mechanism. Like arm rest 362 and arm rest lever 360, second arm rest 363 and arm rest lever 361 are attached to actuating shaft 346.

Chair attachment means 340 is shown in this figure in dotted lines a channel shaped bracket. The chair attachment means 340, as was earlier mentioned, supports the ergonomic foot rest as well as provides the means through which the ergonomic foot rest is attached to the underside of a chair seat or to the tilt mechanism. The location of chair attachment means in relation to the chair seat is best shown in previously described FIGS. 1 and 2.

FIGS. 4*a* and 4*b* show the ergonomic foot rest including a second version of the drive mechanism. FIGS. 5*a* and 5*b* show the ergonomic foot rest including a third version of the drive mechanism. The ergonomic foot rest of FIGS. 4*a* and 4*b*, and FIGS. 5*a* and 5*b* are very similar to the ergonomic foot rest of FIGS. 3*a* and 3*b* with the exception of the drive mechanism employed in each version. Accordingly, FIGS. 4*a* and 4*b*, and FIGS. 5*a* and 5*b* will be described in limited detail.

FIGS. 4*a* and 4*b* show the ergonomic foot rest including a foot rest actuating mechanism including a foot rest actuating mechanism that includes a drive mechanism comprising a compound chain and sprocket train. FIGS. 5*a* and 5*b* show the ergonomic foot rest including a foot rest actuating mechanism including a foot rest actuating mechanism that includes a drive mechanism comprising a compound belt and pulley train. In both versions, the transfer of rotational movement of the arm rest 462 and 562 is transferred through the drive mechanism to the foot rest mechanism in the same manner as was described in FIGS. 3*a* and 3*b*. The FIGS. 4*a* and 4*b*, and FIGS. 5*a* and 5*b*, illustrate some of the many different mechanical mechanisms that may be utilized to generate a rotational movement which will act to move the foot rest brace into a usable possible position.

FIGS. 6*a* in a side view, and 6*b* in perspective illustrate a fourth version of the drive mechanism used in the ergonomic foot rest. In greater detail, the drive mechanism uses a compound lever arrangement where rearward rotational movement of the arm rest lever 662 and shaft 646 results in the forward movement of the foot rest brace 622. In particular, rearward rotation of the arm rest lever 660 pushes on lever arm 674 through lever 672. The force acting on lever arm 674 results in the rotation of the lever arm about shaft 648. This rotation further causes the lever arm 674 to push on lever arm 678 through the lever 676. The rotation of lever arm 678 rotates the shaft 642 which further rotates support arm 678 which also moves foot rest brace 622 into a usable position. The movement of the foot rest brace is again in a restricted path known as curvilinear translation due to the parallelogram structure which includes strut 624 and support arm 627 which hangs freely on shaft 644. Forward movement of the arm rest 662 and arm rest lever 660 result in the rearward movement of the foot rest brace 622.

Also included in this version is a locking mechanism that includes a plunger head 696 shown engaging a toothed gear 680 in a similar manner as was described in FIG. 3*a*.

FIGS. 7*a* and 7*b* show a fifth drive mechanism for the ergonomic foot rest. The drive mechanism comprises a gas spring 750 which includes a cylinder 751, a piston 752 extending from one end of the cylinder 751, and a valve extension 753 which extends from the other end of the cylinder 751 and originating from a valve which is positioned within the cylinder interior (not shown).

The gas spring is supported by a mechanism which allows the gas spring to pivot during operation. This mechanism includes a flat plate 754 disposed between opposing convex plates 755 and 756. The flat plate 754, which is disposed around and secured to the gas spring cylinder, is allowed to pivot about the opposing convex plates 755 and 756. Convex plates 755 and 756 further include enlarged openings therein, through which the gas spring cylinder passes and within which the gas spring cylinder and the attached flat plate can pivot. The convex plates would typically be attached to the chair attachment means by a suitable structural support. This attachment has been omitted from the drawing as it would unnecessarily complicate the drawing by obstructing other elements.

The rearward rotation of the arm rests 762 and 760 causes arm rest lever extension tab 764 to engage and depress the valve extension 753 of the gas spring 750. The valve extension extends from an internal valve assembly within the gas spring cylinder 750. Depressing the valve allows either gas or a damping fluid to pass through the valve which allows the pressurized gas within the cylinder to push the piston out from the cylinder. As the piston is pushed away from the cylinder, the piston end engages a tab 765 disposed between the front support arms 726 and 729 causing the support arms and the foot rest brace 722 to rotate forward.

The parallelogram support arm structure will again move in a path known as curvilinear translation. The gas spring and attached flat plate 754 will pivot slightly about the convex plates during this movement.

Once the arm rest is released from the rearward position where the arm rest lever extension 764 depresses the valve extension 753, the valve within the gas spring cylinder will close, thus locking the foot rest in place. Retracting the foot rest brace requires that the user again rotate the arm rest rearward which opens the internal valve and unlocks the gas spring. Once the valve is open, the user needs only to apply a force on the foot rest brace 722 which exceeds the small force caused by the internal pressurized gas within the gas spring. This small force applied by the feet will cause the foot rest brace to move rearwardly until the user again releases the arm rest to lock the foot rest brace in the new position.

FIGS. 8*a* and 8*b* show a sixth version of the drive mechanism for the ergonomic foot rest. This version differs from that shown in FIGS. 7*a* and 7*b* in the manner the gas spring valve extension is depressed. The gas spring valve extension 853 is engaged and depressed by a cable actuated arm 867. The actuation mechanism includes an actuation lever 864 which pulls on an actuation cable 866 which passes through cable housing 865. Pulling actuation lever 864 results in the cable 866 pulling the arm 867 which moves the arm into engagement and depresses the valve extension 853. Once again, depressing the valve extension allows the internal pressure within the gas spring cylinder to push the piston 852 away from the cylinder causing the piston to push the shaft 871 which extends between the front pair of support arms 826 and 829. This movement moves the foot rest brace 822 into a usable extended position. The movement will continue until the gas spring piston is fully extended from the cylinder or until the lever 864 is released. The gas spring is supported for pivotable movement by shaft 869 which allows the gas spring to pivot as it extends. Alternatively, the gas spring could push on the rear support arms. The shaft 869 would typically be attached to the chair attachment means. This attachment has been omitted from the drawing as it would unnecessarily complicate the drawing by obstructing other elements.

Again, retracting the foot rest brace requires that the user pull lever 864 while applying a rearward force on the foot rest brace 822 which exceeds the small pushing force of the internal pressurized gas acting on the piston.

The internal mechanism of the gas springs have not been shown as gas springs are well known. The gas springs used in the versions of FIGS. 7*a* and 7*b*, 8*a* and 8*b* are smaller versions of gas springs that are commonly used in work chairs to provide vertical seat adjustment. Spring mechanisms such as metallic coil springs, microcellular foam, and elastomeric springs have also been used in similar spring mechanisms that would be suitable for the purposes shown and described. Such mechanisms use similar locking valves as has been previously described. For this reason, the spring mechanisms shown used in the drive mechanisms of FIGS. 7*a* and 7*b*, 8*a* and 8*b*, although described as gas springs, could use any of a number of springs materials including but not limited to: pressurized gas, metallic coil, microcellular foam, and elastomeric materials.

FIGS. 9*a* and 9*b* show two versions of the ergonomic foot rest that use a drive mechanism that is a combination of gas spring and mechanical components. In particular, FIG. 9*a* shows a version where a gas spring 950*a* is used to extend the foot rest brace 922 and the mechanical compound lever drive mechanism, first shown in FIGS. 6*a* and 6*b*, is used to retract the foot rest brace 922.

FIG. 9*b* shows the gas spring 950*b* mounted in a second position where the gas spring will serve to retract the foot rest brace 922 and the mechanical compound lever drive mechanism will be used to extend the foot rest brace 922 into a usable position.

FIGS. 9*a* and 9*b* both show the use of a lockable gas spring mechanism which are distinguished by the inclusion of a valve extension 953a and 953b. In both of these versions a non-locking gas spring could have been used and a locking mechanism like those shown in FIGS. 3*a*–6*b*, or that shown in later described FIGS. 13*a* and 13*b*, could have been used to perform the locking function. Any of the previous mechanical drive mechanisms that were previously described could be used in combination with a gas spring. Additionally, two gas springs could also be utilized, one for extension and a second one for retraction. Or, each gas spring could actuate separate, individual foot rest braces.

Other drive mechanisms which are not explicitly shown in the figures could also have been used in the present invention. Examples of other drive mechanisms include the use of electro-mechanical devices like motors, pneumatics, and hydraulics.

FIGS. 10*a* and 10*b* show a version of the ergonomic foot rest 1020 which utilizes a foot rest mechanism that comprises a pivoting pendulum structure instead of the previously shown and described pivoting parallelogram structure. FIG. 10*a* shows the foot rest brace 1022 in a retracted position and FIG. 10*b* shows the foot rest brace 1022 pivoted into the extended position. A single support arm 1026 is shown in these two figures. Accordingly, a single support arm may be used to support the foot rest platform 1022 in a T-bar configuration. Alternatively, two support arms may also be used. A two support arm configuration would be similar to removing the rear two legs from the parallelogram arrangement as was previously described. The absence of a rear support arm allows the foot rest brace to move in a circular path as opposed to the curvilinear translational path that a parallelogram will move.

FIGS. 10*a* and 10*b* show the use of a pivoting arm rest 1062 and arm rest lever 1060 within an actuation mechanism. Like the previously described parallelogram versions of the invention, the pendulum structure may be used with any of the previously described drive mechanisms. Alternatively, a non-pivoting arm rest could be used along with a gas spring mechanism that is cable actuated as was shown in FIGS. 8*a* and 8*b*.

FIGS. 10*a* and 10*b* also show length adjustable support arm holes 1031. The length adjustment could be accomplished by an arrangement of overlapping or telescoping elements or any other suitable means. FIGS. 11*a* and 11*b* show a telescoping mechanism used for length adjustment which are commonly found in adjustable arm rests of current work chairs. The telescoping system comprises a outer leg section 1102 and an inner leg section 1104 and a telescoping mechanism which comprises a rotating knob 1106 which is mounted on the outer leg. The knob 1106 includes two lugs 1108 and 1110. The lugs are shown in FIG. 11*a* disposed in the top two detents at the top of the lower legs portion of the mechanism. In this position the legs are at the fully extended position with the minimum of overlap. The lower leg includes a vertical row of detents 1112 for the disposal of knob lugs. Adjacent to the row of detents is a small plate 1114 and a spring 1116 disposed against the plate to hold the plate against the row of detents. By turning the knob of FIG. 11*a* clockwise the top lug 1108 will push against the plate and move the plate away from the row of detents. Further turning of the knob will allow the knob to pivot about the lower lug which remains disposed within the detent. Finishing turning the knob a full 180 degrees will result in the lug 1108 leaping over lug 1110 and moving into the next lower detent below the detent holding the lug 1108. The spring will urge the plate again into contact with the row of detents to temporarily hold the mechanism in this position until an adjustment is made. Obviously, an adjustment greater than one 180 degree turn is possible.

FIG. 11*b* shows the knob after it has been turned repeatedly until it is in the bottom two detents. In this position, the telescoping outer leg 1102 has telescoped over the inner leg 1104 to the maximum extent possible. This results in the leg being in the shortest condition possible.

FIG. 12 first shows how a hand grip 1262 could be used in place of an arm rest in the actuation mechanism. The hand grip is attached to a hand grip lever 1260 which is secured to a drive shaft 1246. FIG. 12 also shows how a drive mechanism could use a first gear 1270 which rotates a second gear 1272 which rotates shaft 1244. Support arm 1227 is secured to the shaft 1244 so that rotation of shaft causes the support arm 1227 to also rotate. In this version a forward rotation of the hand grip 1262 will result in the counter clockwise rotation of drive shaft 1246 and the attached gear 1270. The counter clockwise rotation of gear 1270 will cause gear 1272 and shaft 1244 to rotate clockwise. The clockwise rotation of shaft 1244 will cause the support arm 1227 to also rotate in a clockwise direction resulting in the movement of foot rest brace 1222 into a usable position in front of the chair seat. Support arm 1226 and strut 1224 complete a parallelogram which restricts the movement of the foot rest brace 1222 to a path known as curvilinear translation. FIG. 12 also shows a locking mechanism including a gear having serrated teeth 1284 which allow the teeth to push plunger head 1296 away from the gear when the hand grip is being turned rearward (clockwise). This gives the locking mechanism a ratcheting property. Forward rotation of the hand grip requires the pulling of the lever 1290 to retract the plunger head 1296 from engagement with the gear teeth 1284. The use of hand grip 1262 would be possible in place of the arm rest on any previously described versions of the invention.

FIGS. 13*a* and 13*b* show a locking mechanism that may be used with the ergonomic foot rest of the present invention. The locking mechanism includes a strut 1324 having an arched detention plate 1370 having detents 1372 and a pivot slot 1325. Pivotally attached to strut 1324 is support arm 1327 which includes pin 1374. The pivot attachment of support arm 1326 to strut 1324 includes a pivot pin 1376 secured to support arm 1327 and which is acted against by spring 1378 which is disposed in slot 1325. FIG. 13*a* shows how a force F, which is in use the weight of the feet, acting on foot rest brace 1322 will cause spring 1378 to compress allowing the detention plate 1370 to push against pin 1374, and thus urging pin 1374 into a detent 1372. This acts to lock the pivot in position and secures the foot rest brace in the corresponding position.

FIG. 13*b* shows how removing the force F from the foot rest brace 1322 allows the spring 1378 to extend to push the strut downward in relation to the pin 1376. This moves the detention plate away from the pin 1374 and allows for unrestricted pivoting of the support arm and strut for repositioning. Once the foot rest brace is in a desired position, the application of the force F on the foot rest brace will again lock the pivot into the new position as was shown in FIG. 13*a*.

It is understood that the different locking mechanisms including that which is shown in FIGS. 13*a* and 13*b* are usable on all versions of the invention. Also, the use of two support arms as shown in FIGS. 10*a* and 10*b* would also work on all versions of the invention. Also possible would be a T-Bar type of support arm structure that would comprise front and rear arms as are shown in FIGS. 1 and 2, or a single arm as is shown in FIGS. 10*a* and 10*b*. Accordingly, the teachings of the different versions of the invention are interchangeable.

It is also understood that various modifications and changes in form or detail could readily be made without departing from the spirit of the invention. It is therefore intended that the invention be not limited to the exact form and detail herein shown and described, nor to anything less than the whole of the invention herein disclosed and as hereinafter claimed.

I claim:

1. In combination, a work chair and a foot rest mechanism for a work chair comprising:

a work chair including a base, a column disposed on the base, and a chair seat having a perimeter edge including at least a front edge and two side edges;

a foot rest comprising:

chair attachment means for attachment to the work chair proximate to the underside of the work chair seat; wherein the chair attachment means is disposed substantially within the perimeter edge of the chair seat;

a foot rest actuating mechanism supported by the chair attachment means for rotational movement in relation to the chair attachment means; and a foot rest brace and at least one foot rest brace support arm disposed between the foot rest brace and the foot rest actuating mechanism;

a first pivot on the chair attachment means; wherein the first pivot is disposed in a substantially horizontal orientation;

wherein the at least one foot rest brace support arm is pivotally attached to the chair attachment means at the first pivot for movement in a substantially vertical plane;

and wherein the at least one foot rest brace support arm moveably suspends the foot rest brace in relation to the chair attachment means; and, wherein the foot rest brace includes a foot contact surface;

and, wherein the foot rest actuating mechanism engages the at least one foot rest brace support arm, wherein movement of the foot rest actuating mechanism moves the foot contact surface;

wherein the foot rest brace may be centered in relation to the front edge of the chair seat;

and wherein the rest brace surface when centered in relation to the front edge of the chair seat is selectively movable through at least a range of movement from a position where the entirety of each foot rest brace support arm as well as the foot rest brace are substantially disposed beneath the front edge of the chair seat, within the perimeter edge of the chair seat; to a position where the foot rest brace is substantially in front of the front of the chair seat;

wherein the foot contact surface is separated from the chair seat by a spaced apart distance substantially equal to the length of the at least one foot rest brace support arm when the foot rest brace is substantially beneath the front edge of the chair seat, as well as when the foot rest brace is disposed in front of the front edge of the chair seat; and wherein the foot contact surface of the foot rest brace is disposed at the spaced apart distance from the chair seat for direct support of a chair user's feet in an elevated position in relation to a surface on which the chair base is supported;

wherein rotational movement of the foot rest actuating mechanism causes the foot rest brace to move in relation to the chair attachment means.

2. The foot rest of claim 1, additionally comprising means to lock the foot rest actuating mechanism in a fixed position in relation to the chair attachment means.

3. The foot rest of claim 1, comprising at least two foot rest brace support arms attached to the foot rest brace; and wherein the at least two support arms are further attached to the foot rest actuating mechanism; and wherein the at least two support arms, the foot rest brace, and the foot rest actuating mechanism comprise a parallelogram structure which supports the foot rest brace for curvilinear translational movement in relation to the work chair seat.

4. The foot rest of claim 1, comprising two foot rest brace support arms wherein the two support arms are attached to the foot rest brace; and wherein the two support arms are attached to the foot rest actuating mechanism; and wherein the two support arms, the foot rest brace, and the foot rest actuating mechanism comprise a pendulum structure which supports the foot rest brace for rotational movement in relation to the work chair seat.

5. The foot rest of claim 1, wherein the foot rest actuating mechanism comprises at least one actuating lever and a drive mechanism.

6. The foot rest of claim 5, wherein the drive mechanism includes drive components that transfer rotational movement of the actuating lever to rotational movement of the foot rest brace in relation to the work chair seat.

7. The foot rest of claim 5, wherein the drive mechanism includes drive components that transfer rotational movement of the actuating lever to curvilinear translational movement of the foot rest brace in relation to the work chair seat.

8. The foot rest of claim 5, wherein the drive mechanism includes a gearing mechanism which transfers rotational movement of the actuating lever to rotational movement of the foot rest brace in relation to the work chair seat; wherein a small rotational movement of the actuating lever causes a large rotational movement of the foot rest brace.

9. The foot rest of claim 5, wherein the drive mechanism includes a gearing mechanism which transfers rotational movement of the actuating lever to a curvilinear translational movement of the foot rest brace in relation to the work chair seat; wherein a small rotational movement of the actuating lever causes a large curvilinear translational movement of the foot rest brace.

10. The foot rest of claim 5, wherein at least one actuating lever includes an arm rest.

11. The foot rest of claim 5, wherein at least one actuating lever includes a hand grip.

12. The foot rest of claim 1, wherein the chair attachment means includes at least first and second vertical plates, wherein each vertical plate is configured to extend downwardly from a chair seat.

13. The foot rest of claim 1, additionally comprising means to adjust the vertical position of the foot rest brace on the foot rest brace support arms.

14. In combination, a work chair and a foot rest mechanism for a work chair comprising:

a work chair including a base, a column disposed on the base, and a chair seat;

a foot rest comprising:

chair attachment means for attachment to the work chair proximate to the underside of the work chair seat;

a foot rest actuating mechanism including a spring mechanism supported by the chair attachment means; wherein the spring mechanism includes a gas spring cylinder and a gas spring piston, and, wherein the spring piston moves axially in relation to the spring cylinder; and, wherein the foot rest actuating mechanism includes means to actuate movement of the spring piston in relation to the spring cylinder;

a foot rest brace and at least one foot rest brace support arm; wherein each support arm includes a first and second end; wherein the first end of at least one support arm is attached to the foot rest brace; and wherein the second end of at least one support arm is attached to the foot rest actuating mechanism; wherein the support arms moveably suspend the foot rest brace in relation to a chair seat; and wherein the foot rest brace includes a foot contact surface;

wherein the foot contact surface is separated from the chair seat by a spaced apart distance substantially equal to the length of the at least one foot rest brace support arm when the foot rest brace is substantially beneath the front of the chair seat, as well as when the foot rest brace is disposed in front of the front of the chair seat; and wherein the foot contact surface of the foot rest brace is disposed at the spaced apart distance from the chair seat for direct support of a chair user's feet in an elevated position in relation to a surface on which the chair base is supported;

wherein movement of the gas spring piston in relation to the gas spring cylinder of the foot rest actuating mechanism causes the foot rest brace to move in relation to the chair attachment means.

15. The foot rest of claim 14, comprising at least two foot rest brace support arms attached to the foot rest brace; and wherein the at least two support arms are further attached to the foot rest actuating mechanism; and wherein the at least two support arms, the foot rest brace, and the foot rest actuating mechanism comprise a parallelogram structure which supports the foot rest brace for curvilinear translational movement in relation to the work chair seat.

16. The foot rest of claim 14, comprising two foot rest brace support arms wherein the two support arms are attached to the foot rest brace; and wherein the two support arms are attached to the foot rest actuating mechanism; and wherein the two support arms, the foot rest brace, and the foot rest actuating mechanism comprise a pendulum structure which supports the foot rest brace for rotational movement in relation to the work chair seat.

17. The foot rest of claim 14, wherein the gas spring includes a valve extension; and wherein the means to actuate movement of the gas spring piston in relation to the gas spring cylinder comprises a cable mechanism to move the valve extension.

18. The foot rest of claim 17, wherein the cable mechanism includes a lever disposed on the work chair and a cable having a first end attached to the lever; and wherein the cable includes a second end; means to move the valve extension attached to the second end of the cable.

19. The foot rest of claim 14, wherein the gas spring includes a valve extension; and wherein the means to actuate movement of the gas spring piston in relation to the gas spring cylinder comprises an actuating lever and a tab mechanism moved by the actuating lever to depress the valve extension.

20. The foot rest of claim 19, wherein the actuating lever includes an arm rest.

21. The foot rest of claim 19, wherein the actuating lever includes a hand grip.

22. In combination, a work chair and a foot rest mechanism for a work chair comprising:

a work chair including a base, a column disposed on the base, and a chair seat;

a foot rest comprising:

chair attachment means for attachment to the work chair proximate to the underside of the chair seat;

a foot rest actuating mechanism supported by the chair attachment means for rotational movement in relation to the chair attachment means; and wherein the foot rest actuating mechanism includes an actuating lever for selective rotational movement in relation to the chair attachment means; and, wherein the actuating lever extends from a first position at the chair attachment means to a second position disposed at a vertical position above the chair seat;

a foot rest brace and at least one foot rest brace surface support arm disposed between the foot rest brace and the chair attachment means; wherein the at least one support arm moveably suspends the foot rest brace; and wherein the foot rest brace is disposed for direct support of a chair user's feet in an elevated position in relation to a surface on which the chair base is supported; and wherein selective rotational movement of the actuating lever actuates movement of the foot rest brace.

23. The foot rest of claim 22, wherein the actuating lever includes a hand grip disposed above the chair seat.

24. The foot rest of claim 22, wherein the actuating lever includes an arm rest disposed above the chair seat.

25. The foot rest of claim 22, wherein the foot rest actuating mechanism includes a spring mechanism supported by the chair attachment means; wherein the spring mechanism includes a gas spring cylinder and a gas spring piston, and, wherein the spring piston moves axially in relation to the spring cylinder; and, wherein the foot rest actuating mechanism includes means to actuate movement of the spring piston in relation to the spring cylinder; wherein movement of the actuating lever moves the means to actuate movement of the spring piston in relation to the spring cylinder;

wherein movement of the spring piston in relation to the gas spring cylinder of the foot rest actuating mechanism causes the foot rest brace to move in relation to the chair attachment means.

26. The foot rest of claim 25, wherein the gas spring includes an actuation button; and wherein the means to actuate movement of the gas spring piston in relation to the gas spring cylinder comprises a tab mechanism to depress the actuation button.

27. The foot rest of claim 22, comprising at least two foot rest brace support arms attached to the foot rest brace; and wherein the at least two support arms are further attached to the foot rest actuating mechanism; and wherein the at least two support arms, the foot rest brace, and the foot rest actuating mechanism comprise a parallelogram structure which supports the foot rest brace for curvilinear translational movement in relation to the work chair seat.

28. The foot rest of claim 22, comprising two foot rest brace support arms wherein the two support arms are attached to the foot rest brace; and wherein the two support arms are attached to the foot rest actuating mechanism; and wherein the two support arms, the foot rest brace, and the foot rest actuating mechanism comprise a pendulum structure which supports the foot rest brace for rotational movement in relation to the work chair seat.

29. The foot rest of claim 22, wherein the foot rest actuating mechanism comprises a drive mechanism.

30. The foot rest of claim 29, wherein the drive mechanism includes drive components that transfer rotational movement of the actuating lever to rotational movement of the foot rest brace in relation to the work chair seat.

31. The foot rest of claim 29, wherein the drive mechanism includes drive components that transfer rotational movement of the actuating lever to curvilinear translational movement of the foot rest brace in relation to the work chair seat.

32. The foot rest of claim 29, wherein the drive mechanism includes a gearing mechanism which transfers rotational movement of the actuating lever to rotational movement of the foot rest brace in relation to the work chair seat; wherein a small rotational movement of the actuating lever causes a large rotational movement of the foot rest brace.

33. The foot rest of claim 29, wherein the drive mechanism includes a gearing mechanism which transfers rotational movement of the actuating lever to a curvilinear translational movement of the foot rest brace in relation to the work chair seat; wherein a small rotational movement of the actuating lever causes a large curvilinear translational movement of the foot rest brace.

* * * * *